US007994962B1

(12) United States Patent
Ben-Shmuel

(10) Patent No.: US 7,994,962 B1
(45) Date of Patent: Aug. 9, 2011

(54) APPARATUS AND METHOD FOR CONCENTRATING ELECTROMAGNETIC ENERGY ON A REMOTELY-LOCATED OBJECT

(75) Inventor: Eran Ben-Shmuel, Ganei Tikva (IL)

(73) Assignee: Drosera Ltd., Kfar-Saba (IL)

( * ) Notice: Subject to any disclaimer, the term of this patent is extended or adjusted under 35 U.S.C. 154(b) by 274 days.

(21) Appl. No.: 12/217,167

(22) Filed: Jul. 2, 2008

(30) Foreign Application Priority Data

Jul. 17, 2007 (IL) ..... 184672

(51) Int. Cl.
*H01Q 13/00* (2006.01)

(52) U.S. Cl. ..... 342/13; 342/5

(58) Field of Classification Search ..... 342/22
See application file for complete search history.

(56) References Cited

U.S. PATENT DOCUMENTS 2,489,337 A * 11/1949 Sperling ..... 342/12
2,543,130 A * 2/1951 Robertson ..... 342/6
2,593,067 A 4/1952 Spencer
2,895,828 A 7/1959 Kamide
2,917,739 A * 12/1959 Halpern ..... 342/6
3,151,325 A * 9/1964 Kompfner ..... 342/5
3,231,892 A * 1/1966 Matson et al. ..... 343/775
3,633,538 A 1/1972 Hoeflin
3,806,689 A 4/1974 Kegereis et al.
4,035,599 A 7/1977 Kashyap et al.
4,165,454 A 8/1979 Carlsson et al.
4,196,332 A 4/1980 MacKay et al.
4,250,628 A 2/1981 Smith et al.
4,279,722 A 7/1981 Kirkbride
4,336,435 A 6/1982 Kashyap et al.
4,342,035 A * 7/1982 Anderson et al. ..... 343/792.5
4,342,896 A 8/1982 Teich
4,354,153 A 10/1982 Lentz
4,377,733 A 3/1983 Yamaguchi et al.
4,431,888 A 2/1984 Simpson
4,447,693 A 5/1984 Buck
4,475,024 A 10/1984 Tateda
4,596,915 A 6/1986 Simpson
4,855,555 A 8/1989 Adams et al.
4,897,151 A * 1/1990 Killackey et al. ..... 216/26
5,036,172 A 7/1991 Kokkeler et al.
5,202,095 A 4/1993 Houchin et al.

(Continued)

FOREIGN PATENT DOCUMENTS

CN 1968609 5/2007

(Continued)

OTHER PUBLICATIONS

International Search Report Dated Nov. 13, 2008 From the International Searching Authority Re.: Application No. PCT/IL2008/000231.

(Continued)

*Primary Examiner* — Thomas H Tarcza
*Assistant Examiner* — Matthew M Barker

(57) ABSTRACT

A method for concentrating radio frequency (RF) radiation on an object located in proximity to a reflector includes the steps of: selecting a target reflector and a level of power for conveying to the target reflector by reradiation from the target reflector, determining a resonance profile of the target reflector, the resonance profile including at least one resonant frequency of the target reflector, selecting a transmission profile matching the resonance profile, the transmission profile comprising the at least one resonant frequency, and transmitting RF radiation in accordance with the transmission profile towards the target reflector.

34 Claims, 24 Drawing Sheets

U.S. PATENT DOCUMENTS 5,321,222 A 6/1994 Bible et al.
5,321,897 A 6/1994 Holst et al.
5,339,564 A 8/1994 Wilson et al.
5,451,751 A 9/1995 Takimoto et al.
5,468,940 A 11/1995 Kang
5,512,736 A 4/1996 Kang et al.
5,521,360 A 5/1996 Johnson et al.
5,616,268 A 4/1997 Carr
5,698,128 A 12/1997 Sakai et al.
5,721,286 A 2/1998 Lauf et al.
5,798,395 A 8/1998 Lauf et al.
5,804,801 A 9/1998 Lauf et al.
5,818,649 A * 10/1998 Anderson ..... 359/726
5,828,042 A 10/1998 Choi et al.
5,873,254 A 2/1999 Arav
5,877,479 A 3/1999 Yu
5,927,265 A 7/1999 McKee et al.
5,961,871 A 10/1999 Bible et al.
5,977,532 A 11/1999 Ekemar
5,981,928 A 11/1999 Lee
5,998,775 A 12/1999 Sung
6,060,701 A 5/2000 McKee et al.
6,096,361 A 8/2000 Yamane et al.
6,114,677 A 9/2000 Idomoto et al.
6,166,551 A 12/2000 Scott et al.
6,169,277 B1 1/2001 Feher et al.
6,169,524 B1 1/2001 Wu et al.
6,172,348 B1 1/2001 Yoshino et al.
6,191,402 B1 2/2001 Ekemar
6,225,940 B1 * 5/2001 Ohlsen ..... 342/5
6,249,710 B1 6/2001 Drucker et al.
6,262,406 B1 7/2001 McKee et al.
6,274,859 B1 8/2001 Yoshino et al.
6,320,165 B1 11/2001 Ovadia
6,320,171 B1 11/2001 Kim
6,384,392 B1 5/2002 Lee et al.
6,388,620 B1 5/2002 Bhattacharyya
6,429,823 B1 8/2002 Bains et al.
6,444,966 B2 9/2002 Mukumoto et al.
6,462,320 B1 10/2002 Fuls et al.
6,476,766 B1 11/2002 Cohen
6,487,950 B2 * 12/2002 Samland ..... 89/1.13
6,537,492 B1 3/2003 Sogaard
6,563,097 B2 5/2003 Taino et al.
6,563,472 B2 5/2003 Durham et al.
6,576,879 B1 6/2003 Hoh
6,586,714 B2 7/2003 Kawamura et al.
6,590,192 B2 7/2003 Taino et al.
6,614,011 B2 9/2003 Omori et al.
6,657,173 B2 12/2003 Flugstad et al.
6,674,056 B2 1/2004 Lee
6,680,467 B1 1/2004 Whipple, Jr.
6,686,567 B1 2/2004 Hwang
6,720,541 B2 4/2004 Watanabe et al.
6,770,859 B2 8/2004 Kang
6,812,443 B2 11/2004 Noda et al.
6,815,644 B1 11/2004 Muegge et al.
6,838,648 B2 1/2005 Watanabe et al.
6,861,632 B2 3/2005 Lee
6,867,402 B1 3/2005 Schulte
6,874,495 B2 4/2005 McFadden
6,880,545 B2 4/2005 Heber et al.
6,884,979 B1 4/2005 Torngren et al.
6,914,226 B2 7/2005 Ottaway
6,982,401 B2 1/2006 Hu et al.
7,030,347 B2 4/2006 Lee et al.
7,053,346 B2 5/2006 Cheng et al.
7,055,518 B2 6/2006 McFadden et al.
7,087,872 B1 8/2006 Dobie et al.
7,105,787 B2 9/2006 Clemen, Jr.
7,105,789 B2 9/2006 Ekemar
7,145,119 B1 12/2006 Kim et al.
7,166,824 B2 1/2007 Kanzaki et al.
7,199,341 B2 4/2007 Kaneko et al.
7,208,710 B2 4/2007 Gregoire et al.
7,235,763 B2 6/2007 Christiaansen et al.
7,258,881 B2 8/2007 Jones et al.
7,360,533 B2 4/2008 McFadden
7,388,180 B2 6/2008 Kim et al.
7,409,311 B2 8/2008 Imgram et al.
7,490,538 B2 * 2/2009 Lowell et al. ..... 89/1.11
7,612,315 B2 11/2009 Corradini
7,626,468 B2 * 12/2009 Staines ..... 331/96
7,629,921 B1 * 12/2009 Manry et al. ..... 342/179
2002/0162836 A1 11/2002 Taino et al.
2004/0134904 A1 7/2004 Clemen, Jr.
2004/0211765 A1 10/2004 McFadden
2004/0216732 A1 11/2004 McFadden
2004/0232140 A1 11/2004 Kanzaki et al.
2005/0080373 A1 4/2005 Wang
2005/0092314 A1 5/2005 Rabas et al.
2006/0049725 A1 3/2006 Simon
2006/0259547 A1 11/2006 Bogatin et al.
2006/0289526 A1 12/2006 Takizaki et al.
2007/0137633 A1 6/2007 McFadden
2007/0215608 A1 9/2007 Yoshino et al.
2007/0215612 A1 9/2007 Hicks et al.
2007/0272684 A1 11/2007 Lee
2007/0278218 A1 12/2007 Claesson et al.
2008/0047948 A1 2/2008 Rosenbloom et al.
2008/0047959 A1 2/2008 Moriya et al.
2008/0087662 A1 4/2008 Takizaki et al.
2008/0105136 A1 5/2008 McFadden
2008/0105675 A1 5/2008 Choi et al.
2008/0106483 A1 5/2008 McFadden et al.
2008/0193614 A1 8/2008 Greiner et al.
2008/0206420 A1 8/2008 McFadden
2008/0264269 A1 10/2008 Sterzel et al.
2008/0280000 A1 11/2008 Breunig et al.
2008/0290087 A1 11/2008 Ben-Shmuel et al.
2008/0296284 A1 12/2008 McFadden et al.
2009/0014315 A1 1/2009 Chen
2009/0045191 A1 2/2009 Ben-Shmuel et al.
2009/0057302 A1 3/2009 Ben-Shmuel et al.
2009/0236333 A1 9/2009 Ben-Shmuel et al.
2009/0236334 A1 9/2009 Ben-Shmuel et al.
2009/0236335 A1 9/2009 Ben-Shmuel et al.
2009/0256706 A1 * 10/2009 Brown ..... 340/552
2009/0274802 A1 11/2009 Kling et al.

FOREIGN PATENT DOCUMENTS

DE 10200702562 10/2007
DE 102007025245 10/2007
DE 102007025263 10/2007
DE 102007025264 10/2007
DE 102007035357 2/2009
DE 102007035359 2/2009
EP 0268379 5/1988
EP 0429822 6/1991
EP 0615763 9/1994
EP 0752195 1/1997
EP 0934681 8/1999
EP 1447632 8/2004
EP 1515102 3/2005
EP 1987288 11/2008
EP 2053315 4/2009
EP 2098788 9/2009
GB 2033587 5/1980
JP 06-193884 7/1994
JP 06-310268 11/1994
JP 08-064359 3/1996
JP 09-229372 9/1997
JP 2001-086967 4/2001
WO WO 91/07069 5/1991
WO WO 95/27387 10/1995
WO WO 95/27388 10/1995
WO WO 97/36728 10/1997
WO WO 99/13688 3/1999
WO WO 02/23953 3/2002
WO WO 03/056919 7/2002
WO WO 2005/027644 3/2005
WO WO 2005/041672 5/2005
WO WO 2005/073449 8/2005
WO WO 2005/106333 11/2005
WO WO 2006/016372 2/2006
WO WO 2007/018565 2/2007
WO WO 2007/096877 8/2007

| | | |
|---|---|---|
| WO | WO 2007/096878 | 8/2007 |
| WO | WO 2008/007368 | 1/2008 |
| WO | WO 2008/048497 | 4/2008 |
| WO | WO 2008/087618 | 7/2008 |
| WO | WO 2008/102334 | 8/2008 |
| WO | WO 2008/102360 | 8/2008 |
| WO | WO 2008/143942 | 11/2008 |
| WO | WO 2008/145213 | 12/2008 |
| WO | WO 2008/145214 | 12/2008 |
| WO | WO 2008/145216 | 12/2008 |
| WO | WO 2008/145217 | 12/2008 |
| WO | WO 2009/104191 | 8/2009 |
| WO | WO 2010/052723 | 5/2010 |
| WO | WO 2010/052724 | 5/2010 |
| WO | WO 2010/052725 | 5/2010 |

OTHER PUBLICATIONS

Written Opinion Dated Nov. 13, 2008 From the International Searching Authority Re.: Application No. PCT/IL2008/000231.
Bird "Antenna Feeds", Encylopedia of RF and Microwave Engineering, p. 185-217, 2005.
Foster et al. "Biological Effects of Radiofrequency Energy as Related to Health and Safety", Encyclopedia of RF and Microwave Engineering, p. 511-523, 2005.
Foster et al. "Dielectric Properties of Tissues", Handbook of Biological Effects of Electromagnetic Fields, CRC Press, 2nd Ed., p. 25-63, 1996.
Hambling "Tech Watch: Forecasting Pain", Popular Mechanics, 183(12): 32, Dec. 2006.
Repacholi "Radiofrequency Electromagnetic Field Exposure Standards", IEEE Engineering in Medicine and Biology Magazine, 6: 18-21, Mar. 1987.
Schwan et al. "RF-Field Interactions With Biological Systems: Electrical Properties and Biophysical Mechanisms", Proceedings of the IEEE, 68(1): 104-113, Jan. 1980.
Scott "Understanding Microwaves", A Wiley-Interscience Publication, John Wiley and Sons, p. 327-331, 1993.
Von Hippel "Theory: Macroscopic Properties of Dielectrics", Dielectric Materials and Applications, Artech House, p. 3-5, 1954.
Communication Relating to the Results of the Partial International Search Dated Aug. 3, 2009 From the International Searching Authority Re.: Application No. PCT/IL2009/000199.
International Preliminary Report on Patentability Dated Aug. 26, 2009 From the International Bureau of WIPO Re.: Application No. PCT/IL2007/001073.
International Search Report and the Written Opinion Dated Nov. 25, 2009 From the International Searching Authority Re.: Application No. PCT/IL2009/000199.
Communication Relating to the Results of the Partial International Search Dated Jul. 10, 2007 From the International Searching Authority Re.: Application No. PCT/IL2007/000236.
Communication Relating to the Results of the Partial International Search Dated Oct. 24, 2007 From the International Searching Authority Re.: Applicaiton No. PCT/1L2007/000864.
International Preliminary Report on Patentability Dated Jan. 13, 2009 From the International Bureau of WIPO Re.: Application No. PCT/IL2007/000864.
Communication Relating to the Results of the Partial International Search Dated Aug. 4, 2008 From the International Searching Authority Re.: Application No. PCT/IL2008/000231.
Communication Relating to the Results of the Partial International Search Dated Jul. 10, 2002 From the International Searching Authority Re.: Application No. PCT/IL2007/000235.
International Preliminary Report on Patentability Dated Aug. 26, 2008 From the International Bureau of WIPO Re.: Application No. PCT/2007/000235.
International Preliminary Report on Patentability Dated May 29, 2008 From the International Preliminary Examining Authority Re.: Application No. PCT/IL2007/000236.
Bird "Antenna Feeds", Encyclopedia of Radiofrequency and Macrowave Engineering, p. 185-217, 2005.
Boströom et al. "Rapid Thawing of Fresh-Frozen Plasma With Radio Wave-Based Thawing Technology and Effects on Coagulation Factors During Prolonged Storage at 4° C.", Vox Sanguinis, 97: 34-38, 2009.
Evans "Electromagnetic Rewarming: The Effect of CPA Concentration and Radio Source Frequency on Uniformity and Efficiency of Heating", Cryobiology, 40: 126-138, 2000.
Evans et al. "Design of a UHF Applicator for Rewarming of Cryopreserved Biomaterials", IEEE Transactions on Biomedical Engineering, 39(3): 217-225, Mar. 1992.
Foster et al. "Biological Effects of Radiofrequency Energy As Related to Health and Safety", Encyclopedia of Radiofrequency and Macrowave Engineering, p. 511-523, 1999.
Foster et al. "Dielectric Properties of Tissues", Handbook of Biological Effects of Electromagnetic Fields, CRC Press, 2nd Ed.(Chap.1): 25-101, 1996.
Hambling "Forget Lasers, Phasers and Other Beam Weapons—Radiofrequency Devices Are Here, and They're Set to 'Sting'", Tech Watch: Forecasting Pain, 183(12): 32, Dec. 2006.
Herring et al. "OSU Tunes Into A Cooking Innovation", OSU News & Communication Services, Oregon State University, 2 P., Apr. 30, 2004.
Liang et al. "Multiband Characteristics of Two Fractal Antennas", Microwave and Oprical Technology Letters, 23(4): 242-245, Nov. 20, 1999.
Penfold et al. "Control of Thermal Runaway and Uniformity of Heating in the Electromagnetic Rewarming of A Cryopreserved Kidney Phantom", Cryobiology, 30: 493-508, 1993.
Repacholi "Radiofrequency Electromagnetic Field Exposure Standards", IEEE Engineering in Medicine and Biology Magazine, p. 18-21, Mar. 1987.
Robinson et al. "Electromagnetic Re-Warming of Cryopreserved Tissues: Effect of Choice of Cryoprotectant and Sample Shape on Uniformity of Heating", Physics in Medicine and Biology, 47: 2311-2325, 2002.
Robinson et al. "Rapid Electromagnetic Warming of Cells and Tissues", IEEE Transactions on Biomedical Engineering, 46(12): 1413-1425, Dec. 1999.
Schwan et al. "RF-Field Interactions With Biological Systems: Electrical Properties and Biophysical Mechanisms", Proceedings of the IEEE, 68(1): 104-113, Jan. 1980.
Scott "Understanding Microwaves", A Wiley-Interscience Publication, 1: 326-331, 1993.
Shelley "Inside View on Deep Heat", Eureka Innovative Engineering Design, 2 P., May 14, 2007.
Von Hippel "Theory: A. Macroscopic Properties of Dielectrics. Comples Permittivity and Permeability", Dielectric Materials and Applications, 1: 3-5, 1995.
Walker et al. "Fractal Volume Antennas", Electronics Letters, 34(16): 1536-1537, Aug. 6, 1998.
Wusteman et al. "Vitrification of Large Tissues With Dielectric Warming: Biological Problems and Some Approaches to Their Solution", Cryobiology, 48: 179-189, 2004.
Response Dated Aug. 12, 2010 to Telephonic Interview of Aug. 3, 2010 Pertaining to International Patent Application No. PCT/IL2009/000199.
Response Dated Aug. 19, 2010 to Communication Pursuant to Article 94(3) EPC of Apr. 29, 2010 From the European Patent Office Re.: Application No. 07706172.9.
Response Dated Aug. 19, 2010 to Written Opinion of Mar. 3, 2010 From the International Searching Authority Re.: Application No. PCT/IL2009/001057.
Collin "Circuit Theory for Waveguiding Systems", Foundations for Microwave Engineering, IEEE Press Series on Electromagnetic Wave Theory, 2nd Ed., Chap.4.5-4.8: 233-258, 2001.
Pozer "Microwave Network Analysis", Microwave Engineering, 2nd Ed. Chap.4(4.2-4.3): 191-206, 1998.
Communication Relating to the Results of the Partial International Search Dated Mar. 29, 2010 From the International Searching Authority Re.: Application No. PCT/IL2009/001058.
International Search Report Dated Mar. 3, 2010 From the International Searching Authority Re.: Application No. PCT/IL2009/001057.

Response Dated Feb. 23, 2010 to the Written Opinion of Nov. 25, 2009 From the International Searching Authority Re.: Application No. PCT/IL2009/000199.
Communication Pursuant to Article 94(3) EPC Dated Apr. 29, 2010 From the European Patent Office Re.: Application No. 07706172.9.
International Preliminary Report on Patentability Dated Feb. 14, 2011 From the International Preliminary Examining Authority Re.: Application No. PCT/IL2009/001057.
International Search Report and the Written Opinion Dated Jun. 15, 2010 From the International Searching Authority Re.: Application No. PCT/IL2009/001058.
International Search Report and the Written Opinion Dated May 20, 2008 From the International Searching Authority by the Patent Cooperation Treaty Re.: Application No. PCT/IL2007/001073.
International Search Report and the Written Opinion Dated Jun. 24, 2010 From the International Searching Authority Re.: Application No. PCT/IL2009/001059.
International Search Report and the Written Opinion Dated Dec. 27, 2007 From the International Searching Authority Re.: Application No. PCT/IL2007/000864.
International Search Report and the Written Opinion Dated Aug. 30, 2010 From the International Searching Authority Re. Application No. PCT/IL10/00380.
International Search Report and the Written Opinion Dated Aug. 31, 2007 From the International Searching Authority by the Patent Cooperation Treaty Re.: Application No. PCT/IL20007/000236.
International Search Report Dated Sep. 11, 2007 From the International Searching Authority Re. Application No. PCT/IL2007/000235.
Office Action dated Sep. 20, 2010 From the Israel Patent Office Re. Application No. 184672.
Adams "Microwave Blood Plasma Defroster", Journal of Microwave Power and Electromagnetic Energy, 26(3): 156-159, 1991.
Arens et al. "Danger of Overwarming Blood by Microwave", JAMA, 218(7):1045-1046, 718, Nov. 15, 1971.
Collin "Electromagnetic Theory: Wave Equation", Foundations for Microwave Engineering, IEEE Press Series on Electromagnetic Wave Theory, 2nd Ed., Chap.2.4: 31-32, 2001.
Collin "Transmission Lines and Waveguides", Foundations for Microwave Engineering, IEEE Press Series on Electromagnetic Wave Theory, 2nd Ed., p. 96-99, 2001.
Geedipalli et al. "Heat Transfer in A Combination Microwave-Jet Impingement Oven", Food and Bioproducts Processing, 86: 53-63, 2008.
Hirsch et al. "Indicators of Erythocyte Damage After Microwave Warming of Packed Red Blood Cells", Clinical Chemistry, 49(5): 792-799, 2003.
Hirsch et al. "Temperature Course and Distribution During Plasma Heating With a Microwave Device", Anaesthesia, 58: 444-447, 2003.
Khummongkol et al. "Heat Transfer Between Impinging Air and Impinged Surface: A Factorial Design", The Joint International Conference on 'Sustainable Energy and Environment (SEE)', Hua Hin, Thailand, Dec. 1-3, 2004, 4003(0): 431-436, 2004.
Lapin N9GL's RF Safety Column: The Military's New RF Waepon, ARRL Handbook for Radio Amateurs, American Radio Relay League, 3 P., 2001.
Marcroft et al. "Flow Field in A Hot Air Jet Impingement Oven—Part I: A Single Impinging Jet", Journal of Food Processing Preservation, 23: 217-233, 1999.
Marcroft et al. "Flow Field in A Hot Air Jet Impingement Oven—Part II: Multiple Impingement Jets", Journal of Food Processing Preservation, 23: 235-248, 1999.
Risco "Microwaves and Vascular Perfusion: Obtaining Very Rapid Organ Cooling", Cryobiology, 49: 294, Abstract No. 11, 2004.
Sherman et al. "A New Rapid Method for Thawing Fresh Frozen Plasma", Transfusion, 14(6): 595-597, Nov.-Dec. 1974.
Söhngen et al. "Thawing of Fresh-Frozen Plasma With a New Microwave Oven", Transfusion, 28(6): 576-580, 1988.

* cited by examiner

APPARATUS AND METHOD FOR CONCENTRATING ELECTROMAGNETIC ENERGY ON A REMOTELY-LOCATED OBJECT

RELATED APPLICATION

This application claims the benefit of priority from Israel Patent Application No. 184672, filed on Jul. 17, 2007, the contents of which are incorporated herein by reference.

FIELD AND BACKGROUND OF THE INVENTION

The present invention relates to reflecting electro-magnetic energy from a passive source onto a proximate object, for example in order to reflect electro-magnetic energy from a weapon into a person in proximity to the weapon.

A passive radiator (also named a passive director or reflector) is a radio-frequency (RF) radiation element which does not have any wired input. Instead, it is coupled to radio waves radiated from another active antenna element, and reradiates (i.e. reflects) the RF energy. The reradiation pattern (also named herein the resonance profile) is determined by factors such as the dimensions and arrangement of the passive radiator or radiators, and other factors such as the transmitted frequency, the dielectric surrounding the reflecting object and spatial considerations. If properly configured, the passive radiator reflects the RF radiation in a predetermined and desired fashion.

The use of passive radiators is well known in antenna theory. A passive radiator is used in several types of antennas in order to shape the antenna pattern and bandwidth (see Allan W. Scott, "Understanding Microwave", John Wiley and Sons, pp. 327-331, 1993, and Kai Cheng, "Encyclopedia of RF and Microwave Engineering" pp. 185-217, John Wiley and Sons, 2005).

For example, a typical parabolic antenna consists of a passive parabolic reflector illuminated by a small feed antenna (e.g. a dipole antenna). The parabolic reflector serves to direct the RF radiation emitted by the feed antenna (for example the torroidal radiation pattern of a dipole antenna) into a plane wave and to provide gain.

Another example of an antenna which utilizes passive radiators is the Yagi-Uda antenna. The Yagi-Uda antenna is a directional antenna consisting of an array of a dipole and additional passive radiators. The passive radiators serve as parasitic elements, which modify the dipole radiation pattern into a more directive pattern (e.g. the End-Fire far field pattern).

Passive radio-frequency identification (RFID) utilizes the scattering of RF radiation at certain frequencies to identify an RF tag that is placed between the RFID antennas. The power that is scattered by the RFID and its influence on nearby objects is a side effect which at times is undesired and problematic.

In current transmission systems the passive radiator serves as an antenna component for directing the RF transmission to a receiver (or receiving element). The passive radiator of the antenna is designed for predetermined system purposes and its characteristics are selected to fit predetermined criteria, and are appropriate for the RF transmission characteristics.

The Active Denial System (ADS) is a directed energy weapon developed by the US military. The ADS works by transmitting electromagnetic radiation at a frequency of 95 GHz toward the subjects. The waves excite water molecules in the skin, causing an intensely painful burning sensation.

While not actually burning the skin, the burning sensation is similar to that of a light bulb being pressed against the skin (see David Hambling, 2006, "Techwatch-Forecasting Pain", Popular Mechanics 183(12):32, ISSN 0032-4558). The frequency of 95 GHz was selected because it does not penetrate deeply into the body, thereby affecting external organs only, such as skin. The focused beam is considered effective for targets at a range of just under half a kilometer. A similar, lower-range system named the Silent Guardian™ has been developed by Raytheon.

The Active Denial System (ADS) is a directed energy weapon developed by the US military. The ADS works by transmitting electromagnetic radiation at a frequency of 95 GHz toward the subjects. The waves excite water molecules in the skin, causing an intensely painful burning sensation. While not actually burning the skin, the burning sensation is similar to that of a light bulb being pressed against the skin (see David Hambling, 2006, "Techwatch-Forecasting Pain", Popular Mechanics 183(12):32, ISSN 0032-4558). The frequency of 95 GHz was selected because it does not penetrate deeply into the body, thereby affecting external organs only, such as skin. The focused beam is considered effective for targets at a range of just under half a kilometer. A similar, lower-range system named the Silent Guardian™ has been developed by Raytheon.

EM energy levels somewhat above 1 W/kg inside tissue may become significant or even damaging (see H. P. Schwan and K. R. Foster, "RF-Fields interactions with biological mechanisms", Proc. IEEE 68:104-113 (1980)). The International Committee on Non-Ionizing Radiation Protection (ICNIRP) has set a limit of exposure to RF fields from far-field exposure to 10 W/m$^2$. The U.S. F.C.C. organization had also set the same threshold value, which has been adopted in numerous countries worldwide (see M. H. Repacholi, "Radiofrequency electromagnetic-field exposures standards", IEEE Eng. Med. Biol. 6:18-21 (1987)).

SUMMARY OF THE INVENTION

The embodiments described below include creating a passive source and utilizing the passive source to deliver RF radiation into an absorbing object. The passive source is created by transmitting RF radiation having the appropriate characteristics towards a reflector, whereby the reflector couples with the far field of the active antenna that transmits the RF radiation. As a result, when the passive source is located in proximity to an absorbing object RF radiation is delivered to the absorbing object amplified by the reflector gain, and at least a portion of the RF radiation reflected from the reflector is absorbed by the absorbing object.

Energy delivery is performed by transmitting RF radiation onto a reflector, which denotes an element comprising a radiation reflecting material such as metal. The transmitted radiation may be in any polarization, according to the desired results, and the estimated radiator condition (e.g. orientation or surrounding objects) and position. The radiation is transmitted at an RF frequency which is appropriate for the dimensions, the surroundings and the structure of the given reflector. The reflector couples to the electromagnetic (EM) field as an antenna, and reflects (i.e. reradiates) the RF radiation, thereby becoming a passive source. Energy is transferred directly and/or indirectly to absorbing objects surrounding the reflector, at the power dictated by the radiation pattern of the passive source.

Since the effect is frequency selective, the radiation will not cause other objects having different reflective characteristics to reflect unless they have a similar physical profile, are of the proper dimensions to reflect the harmonics of the transmitted RF frequency and/or contain any structure or other properties that reradiate at those frequencies.

Moreover, since the power density of the reflected radiation is inversely proportional to the distance from the reflector, the amount of energy delivered to objects in proximity to the reflector is significantly greater than the amount delivered to distant objects, as demonstrated in multiple examples below.

For example, FIGS. 1*a* and 1*b* show the results of a simulation in which a reflector 1310 was placed in contact with an absorbing object, and the strength of the electric field that was reradiated from the reflector was measured at several probe sites 1320. FIG. 1*a* shows an expanded view of the tip of reflector 1310, and the locations of the probes 1320. The first probe 1320 was placed at the tip of the reflector and the other probes were placed at a distance of 10 mm from one another, such that the last probe (probe 4) was 30 mm away from the tip. As seen in FIG. 1*b*, the strength of the electric field decreases sharply as the distance of the probe from reflector 1320 increases.

A reflector which reflects RF radiation at a given frequency will also reflect harmonics of the given RF frequency. If necessary due to other factors (such as directivity or RF transmitter bandwidth), the energy transfer effect may also be obtained at these harmonic frequencies.

In some of the examples below, a reflector is modeled as a simple rod serving as a half-dipole antenna. However, real objects typically have complex shapes and compositions and may therefore have complex reflective profiles (i.e. may reflect at multiple frequencies).

At times, electro-magnetic energy may be delivered to an object, according to the present invention, without temperature increase, for example when energy is delivered to an object so rapidly (e.g. by a pulsed transmission) that the desired effect is accomplished before a discernable temperature increase (e.g. less than 1-2° C. increase occurs).

As used herein, the term "object" or "absorbing object" means any object, including a composition of one or more objects, where at least one object or, a portion thereof is capable of absorbing RF energy reflected by a reflector. Likewise, the term "reflector" includes a composition of one or more reflectors.

Preferred embodiments of energy delivery to an object via reradiation from a reflector include: a security system (e.g. for disarming persons holding a weapon or for interfering with the activity of devices), heating objects within a large space, intruder repellant, crowd control and alarm system, and reflector detection and characterization as described in more detail below.

According to one aspect of the present invention there is provided a method for concentrating radio frequency (RF) radiation on an object located in proximity to a reflector. The method includes the steps of: selecting a target reflector and a level of power for conveying to the target reflector by reradiation from the target reflector, determining a resonance profile of the target reflector, the resonance profile including at least one resonant frequency of the target reflector, selecting a transmission profile matching the resonance profile, the transmission profile comprising the at least one resonant frequency, and transmitting RF radiation in accordance with the transmission profile towards the target reflector.

Optionally, the transmission profile comprises a transmission power for the transmitting.

Optionally, the method further comprises setting the transmission power to provide the selected level of power to the target reflector.

Optionally, the method further comprises setting the transmission power to provide a specified level of radiation to the object via the reradiating.

Optionally, the method further comprises setting the transmission power to maintain a level of radiation provided to a second object below a specified limit.

Optionally, the transmission power comprises a uniform power level for all frequencies included in the transmission profile.

Optionally, the transmission power comprises a respective power level for a plurality of transmitted frequencies.

Optionally, the method further comprises setting the transmission power to cause pain to a human in proximity to the reflector.

Optionally, the method further comprises setting the transmission power to discomfort to an animal in proximity to the reflector.

Optionally, the method further comprises setting the transmission power to heat the object.

Optionally, the method further comprises measuring a temperature of the object and adjusting the transmission profile in accordance with the measurements.

Optionally, the transmission profile is defined over a portion of the RF frequency band.

Optionally, the portion of the RF frequency band comprises at least 20 MHz to 10 GHz, 20 MHz to 2 GHz, 188 MHz to 500 MHz, 100 MHz to 188 MHz or 600 MHz to 1.5 GHz, or the RF frequency band comprises frequencies greater than 3 GHz.

Optionally, the resonant frequency comprises a resonance peak frequency, a frequency within a specified frequency band surrounding a resonance peak frequency, a band of frequencies with a specified deviation from the resonance peak frequency where the specified deviation may comprise +/−25% or +/−30% from the resonance peak frequency, and/or a frequency having a transmission coefficient below a background transmission coefficient by at least a specified value, and/or a frequency within a specified frequency band.

Optionally, the transmission profile comprises a transmission type.

Optionally, the transmission type comprises one of: continuous wave (CW) transmission, pulsed transmission, sweep transmission and multiple frequency transmission.

Optionally, the transmission profile comprises a transmission direction.

Optionally, the transmission profile comprises a polarization.

Optionally, the determining a resonance profile comprises determining the at least one resonant frequency in accordance with at least one of: a shape of the target reflector, a composition of the target reflector, a surrounding of the target reflector and absorption properties of a body in proximity to the target reflector.

Optionally, the determining a resonance profile comprises obtaining resonance properties of a specified reflector from a database, and/or receiving a user input describing the resonance profile and/or receiving a data communication describing the resonance profile.

Optionally, the determining a resonance profile comprises selecting a common resonant frequency for a plurality of target reflectors, so as to enable reradiation of RF radiation at the common resonant frequency onto the object via a series of the plurality of target reflectors.

Optionally, the determining a resonance profile comprises excluding at least one specified excluded frequency from the resonance profile, where the excluded frequency may be a resonant frequency of a non-targeted reflector.

Optionally, the transmitting is by a plurality of antennas. The method optionally includes synchronizing the plurality of antennas to form an antenna array.

Optionally, the method further comprises measuring radiation reradiated from a target location over a plurality of frequencies, the measuring being performed from a first location, and optionally a second location. Optionally, the method further comprises analyzing the measurements from the first location, and optionally the second location, to determine at least one resonant frequency of the target reflector, wherein the target reflector is located within the target location. Optionally, the method further comprises analyzing the measurements to identify reflectors located in the target location. Optionally, the method further comprises selecting one of the identified reflectors as the target reflector.

Optionally, the method further comprises: transmitting RF radiation from a plurality of coupled antennas, measuring the absorption of the transmitted RF radiation and determining a size of the object from the measurements, and may further comprise selecting the transmission profile in accordance with the determined size.

Optionally, the method further comprises placing the target reflector in proximity to the object.

Optionally, the method further comprises positioning a shielding material selected to shield a location from the reradiation.

The object may be in contact with the target reflector or may be physically-separated from the target reflector.

Optionally, the method further comprises positioning a transmitter for performing the transmitting in accordance with a location of the target reflector. Optionally, the positioning is further in accordance with a location of the object.

Optionally, the resonance profile comprises a respective reflection level of the target reflector at a plurality of RF frequencies.

Optionally, the resonant frequency comprises a frequency having a respective reflection level greater than a specified level.

According to a second aspect of the present invention there is provided a wireless transmission apparatus for concentrating RF radiation on an object located in proximity to a reflective weapon. The apparatus includes a memory and a transmitter. The memory stores a weapon transmission profile, adapted to the resonance profile of a reflective weapon. The weapon transmission profile includes at least one resonant frequency of the reflective weapon. The transmitter transmits RF radiation toward a target weapon in accordance with the weapon transmission profile, so as to reradiate the RF radiation from the target weapon onto a proximate object.

Optionally, the weapon comprises a firearm.

Optionally, the transmitter comprises a wideband transmitter or a narrowband transmitter configured to transmit at the at least one resonant frequency of the reflective weapon.

Optionally, the transmitter is configured to transmit over a frequency band of at least 20 MHz to 2 GHz, 188 MHz to 500 MHz, 100 MHz to 188 MHz or 600 MHz to 1.5 GHz.

Optionally, the apparatus further comprises a database comprising respective resonance profiles of a plurality of weapon types.

Optionally, the apparatus further comprises a power adjuster configured for adjusting a power of the transmission.

Optionally, the weapon transmission profile further comprises at least one of: a transmission power, a transmission bandwidth, a transmission direction and a transmission type.

Optionally, the apparatus is portable, and may be handheld.

Optionally, the apparatus further comprises a shield configured for blocking the reradiated RF radiation.

According to a third aspect of the present invention there is provided a wireless transmission system for concentrating RF radiation on an object located in proximity to a reflector. The wireless transmission system includes a profile database, a reflector type selector and a transmitter. The profile database includes a plurality of transmission profiles, where each of the transmission profiles is adapted to a resonance profile of a respective reflector type, and each of the transmission profiles includes at least one resonant frequency of the respective reflector type. The reflector type selector is associated with the profile database, and serves for selecting one of the reflector types. The transmitter, which is associated with the reflector type selector, transmits RF radiation toward a target reflector in accordance with the respective transmission profile of the selected reflector type, so as to reradiate the RF radiation from the target reflector onto a proximate object.

Optionally, the transmitter comprises a wideband transmitter or a narrowband transmitter configured to transmit at the at least one resonant frequency.

Optionally, the transmitter is configured to transmit over at least the frequencies included in the transmission profiles.

Optionally, the apparatus further comprises: a reflection measurer, configured for measuring radiation reflected from the target reflector during an RF transmission over a plurality of frequencies, and an analyzer, associated with the reflection measurer, configured for analyzing the measurements to determine at least one resonant frequency of the target reflector. Optionally, the apparatus further comprises a transmission profile generator configured for generating a transmission profile of the target reflector in accordance with the analysis.

According to a fourth aspect of the present invention there is provided a method for adapting an RF transmission to a reflector located within a target location. The method includes the steps of: measuring radiation reflected from the target location during RF transmission over a plurality of frequencies, analyzing the measurements to determine at least one resonant frequency of a reflector located within the target location, defining a transmission profile in accordance with the analyzing, the transmission profile comprising the at least one resonant frequency of the reflector, and transmitting RF radiation towards the target location in accordance with the defined transmission profile, so as to reradiate the RF radiation from the target reflector onto a proximate object.

Optionally, the method further comprises identifying a type of a reflector located in the target location according to the at least one resonant frequency.

Optionally, the method further comprises performing a sweep waveform transmission over a specified RF frequency band, and performing the measuring during the sweep waveform transmission and/or performing a pulse transmission so as to generate RF radiation over a specified RF frequency band, and performing the measuring during the pulse transmission.

Optionally, the analyzing is in accordance with a relative location of a transmitter generating the RF transmission over a plurality of frequencies and a location of the measuring, and may further include measuring radiation reflected from the target location at an additional location and including the measurements from the additional location in the analyzing.

Optionally, the method further comprises the analyzing comprises determining a plurality of frequencies reflected from the target location and selecting one of the determined frequencies as the resonant frequency.

Optionally, the selecting is in accordance with a selection criterion defined to reduce undesired reflection from reflective elements other than the target reflector.

According to a fifth aspect of the present invention there is provided a heating system. The heating system includes at least one reflector element and a transmitter. Each reflector element has a resonance profile which includes at least one resonant frequency, and is positionable in proximity to an object to be heated. The transmitter serves for transmitting RF radiation in accordance with a transmission profile matching the resonance profile, wherein the transmission profile is selected so as to heat the object with RF radiation reradiated from the reflector element, and wherein the transmission profile comprises the at least one resonant frequency of the reflector element.

Optionally, the system further comprises a controller configured for adjusting the transmission profile during the transmitting.

Optionally, the controller is configured to adjust the transmission profile in accordance with measurements from a temperature sensor.

Optionally, the system further comprises a temperature sensor, for measuring a temperature of the object, and for providing the temperature to the controller.

The present invention, in some embodiments thereof, enables the delivery of RF energy to a distant object by reflecting transmitted RF energy from a reflector onto the object, even when the exact characteristics of the reflector are not known.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, examples of suitable methods and materials are described below. In case of conflict, the patent specification, including definitions, will control. In addition, the materials, methods, and examples are illustrative only and not intended to be limiting.

Implementation of the method and system of the present invention involves performing or completing selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF SPECIFIC EMBODIMENTS OF THE INVENTION

Figure 1A:
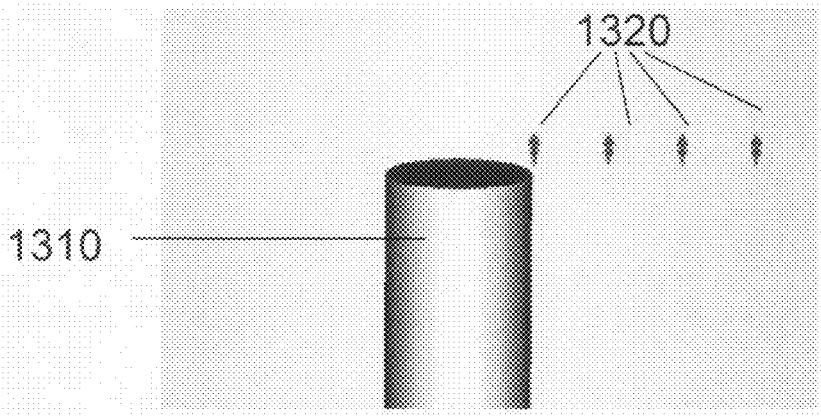
FIG. 1*a* shows an expanded view of a tip of a reflector and the locations of the probes in the reflector's vicinity.
Figure 1B:
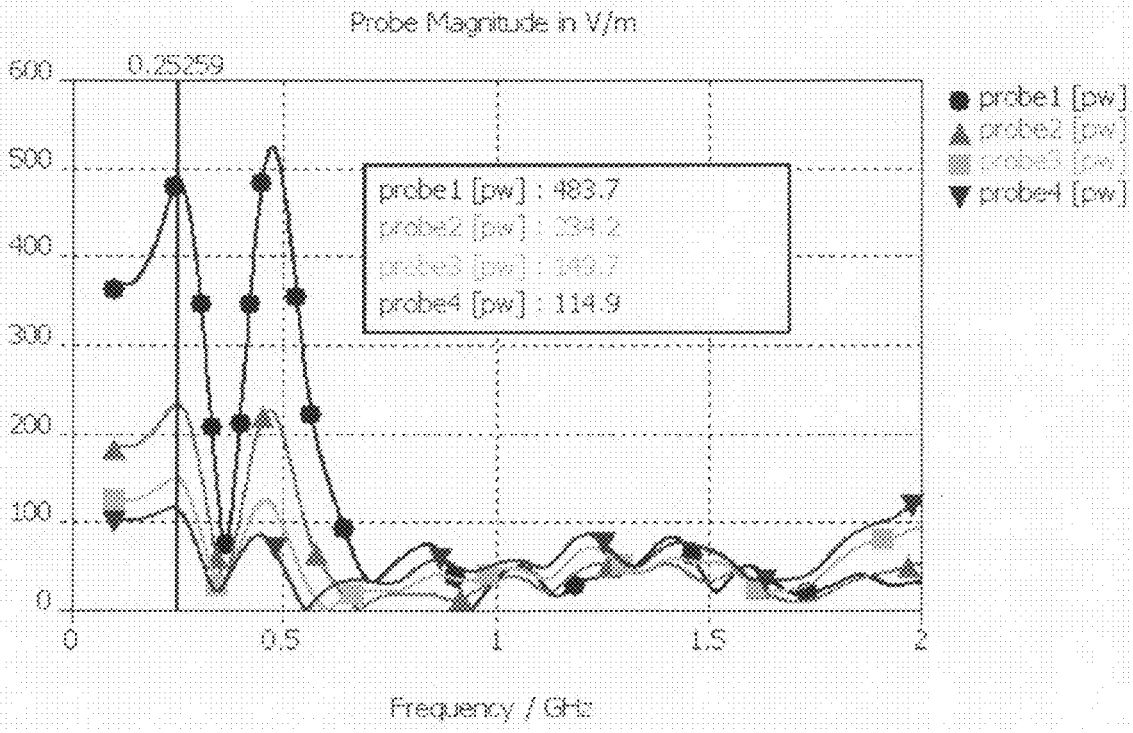
FIG. 1*b* shows simulation results of the strength of the reflected electric field as the distance of the probe from the reflector increases.

The present embodiments are of a system and method which may be used to concentrate RF radiation in a distant object. Specifically, some of the present embodiments match the parameters of the transmitted RF radiation to the reflective characteristics of a target reflector near an absorbing object, so that RF radiation is reflected into the absorbing object. Selection of the transmission parameters is optionally performed while treating the target reflector and the absorbing object as a system.

The present embodiments do not require that either the reflector or the object into which RF radiation is transmitted be contained in a cavity or chamber. The present embodiments are therefore suitable for open-space applications, outdoors as well as indoors, for example in the hostage situations described below.

The embodiments below describe a transmitter having a single, typically parabolic, transmission antenna. However, alternate embodiments may utilize any antenna providing the required radiated pattern, including, for example, an antenna array (with one or more feeds, having controlled phases), loop antenna, wide band antenna, fractal antenna, directional antenna, helix antenna, and further including operating multiple antennas separately or coherently.

The principles and operation of a method for concentrating electro-magnetic energy on a remotely-located object, and embodiments thereof, according to the present invention may be better understood with reference to the drawings and accompanying descriptions.

In the following, parts that are essentially the same as those in previous figures are given the same reference numerals and are not described again except as necessary for an understanding of a given embodiment.

In order to illustrate the operation of the invention according to exemplary embodiments, a simulation was performed of the effects of reflected RF radiation on surrounding objects. In the simulation, one of the objects is close to the reflector whereas the second object is more distant from the reflector. As demonstrated below, by transmitting RF radiation towards the reflector at its resonant frequency, high levels of energy are directed into the first object while the second object is affected only slightly, if at all.

FIGS. 1*c*-3 present simulation results for the transmission of RF radiation to an object via a reflector. The simulation for FIGS. 1*c*-3 was carried out as described above for FIGS. 1*a*-1*b*. As demonstrated by the simulation (and detailed below), the reflector causes a concentration of energy in the nearby object, mainly in the vicinity of the ends of the reflector. The radiation pattern of the reflector is seen to be essentially that of a regular dipole antenna of a calculable effective length (for example see Eqn. 1 below).

Figure 1C:
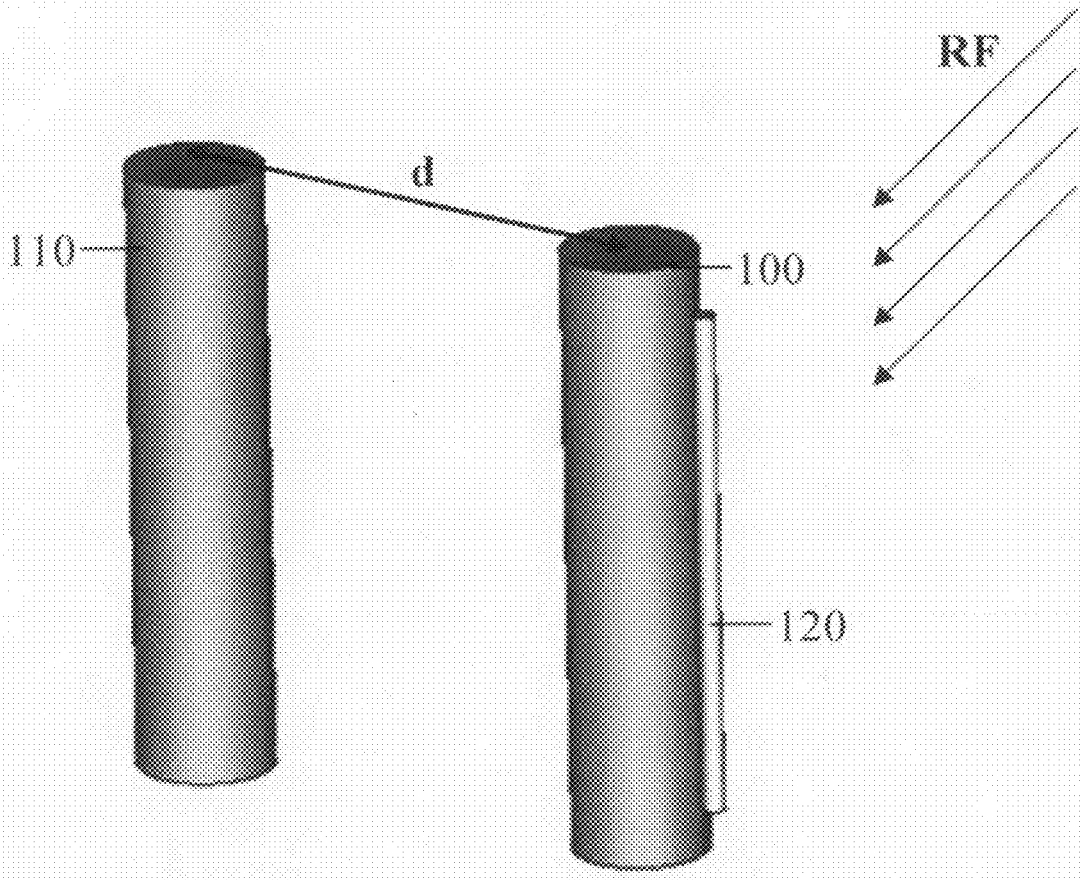
FIG. 1*c* shows two objects and a reflector proximate to one of the objects.

Reference is now made to FIG. 1*c*, which shows two objects, 100 and 110, where object 100 is proximate to reflector 120 and object 110 is distant from reflector 120 by a distance d of 44 cm. Both objects 100 and 110 are modeled as cylinders of a fatty material having a length of 55.5 cm and radius of 6 cm. Reflector 120 is modeled as a metallic cylinder having a length of 45.5 cm and diameter of 2 cm. In the simulation, all the bodies (objects and reflector) were irradiated by an RF transmission of 235.6 MHz. The radiation arrives at reflector 120 (and objects 100 and 110) with an electric field strength of about 100 V/m. As a result, the reflector reradiates the RF energy, thus becoming a passive source.

Figure 2A:
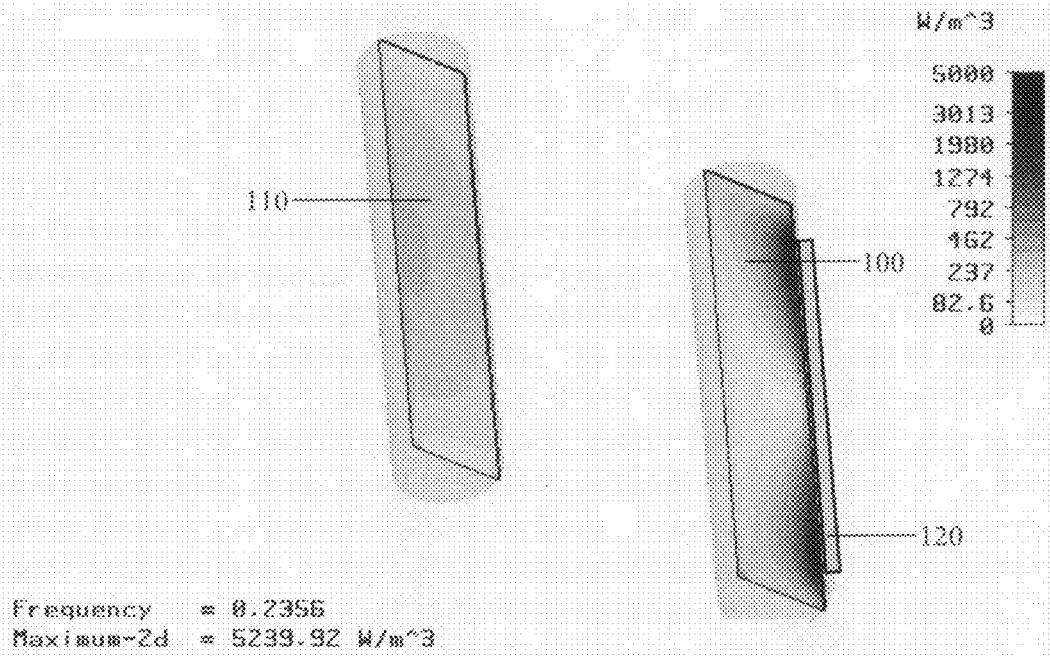
FIGS. 2*a*-2*e* show simulation results of the energy delivered to the objects of FIG. 1*c;*
Figure 2B:
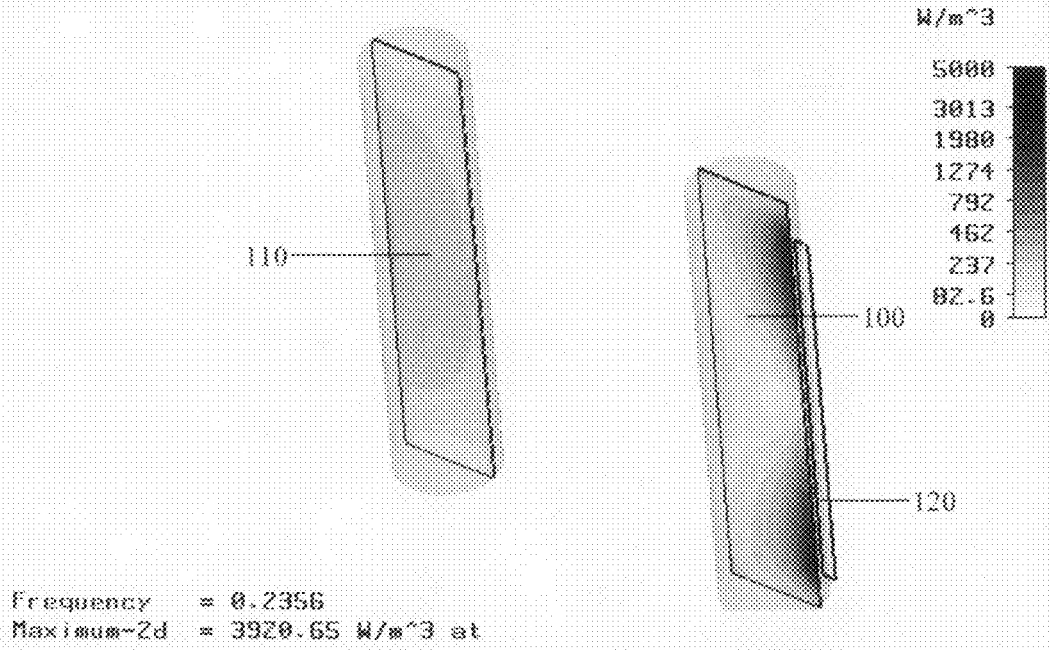
Figure 2C:
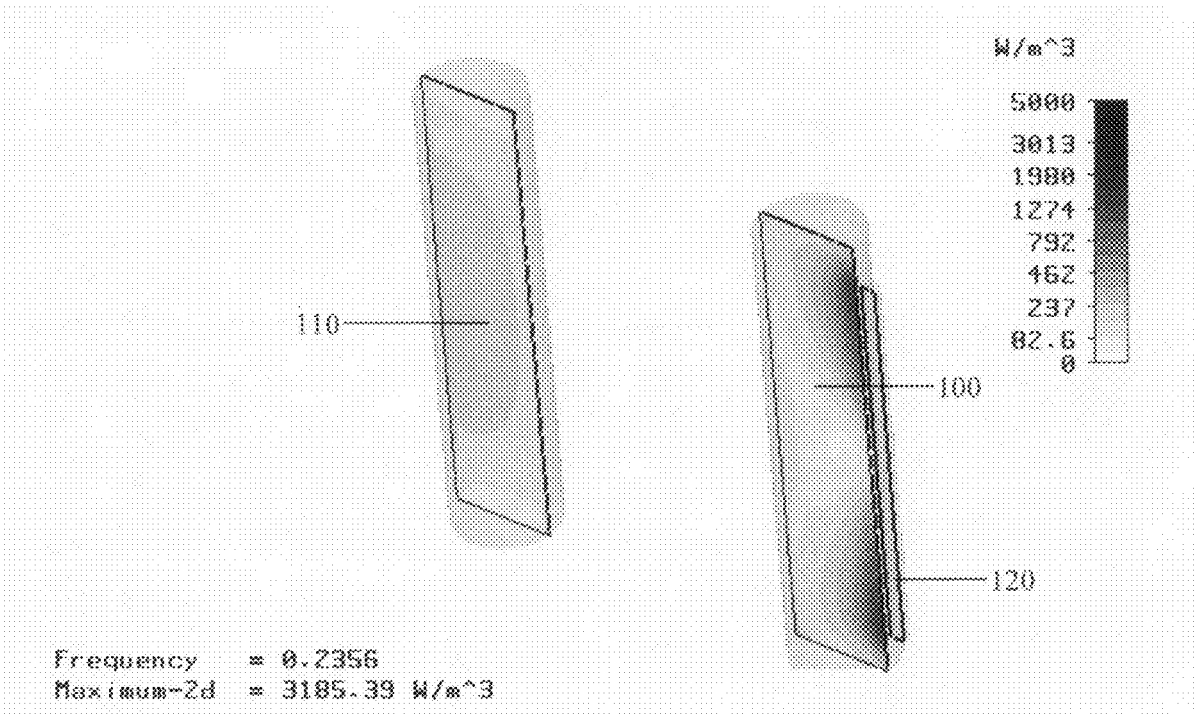
Figure 2D:
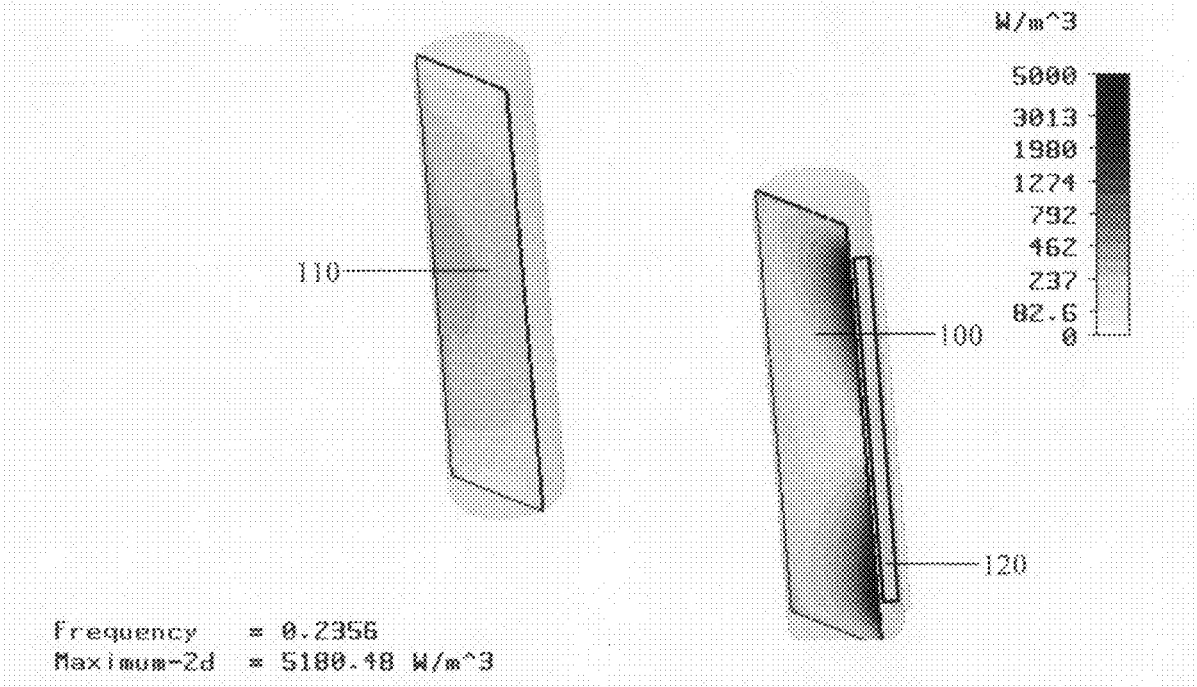
Figure 2E:
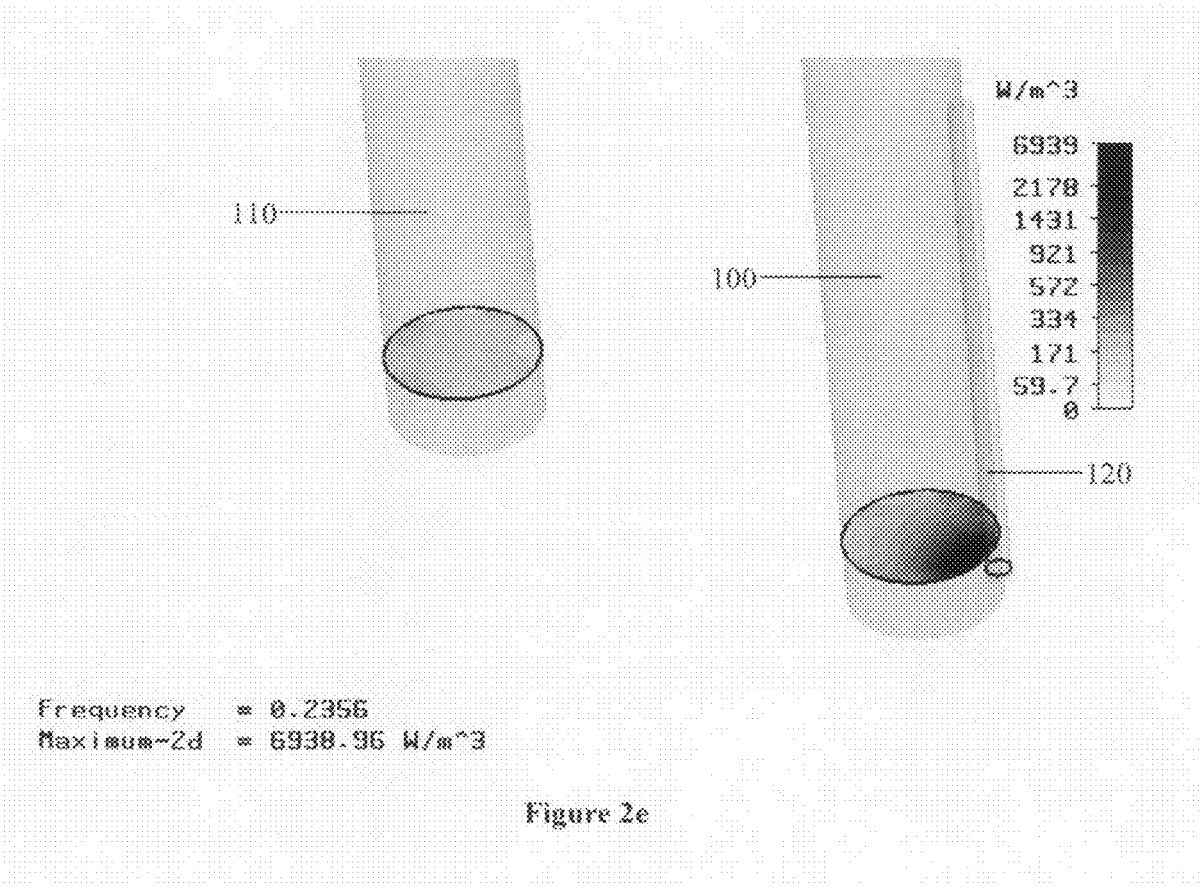
Figure 2F:
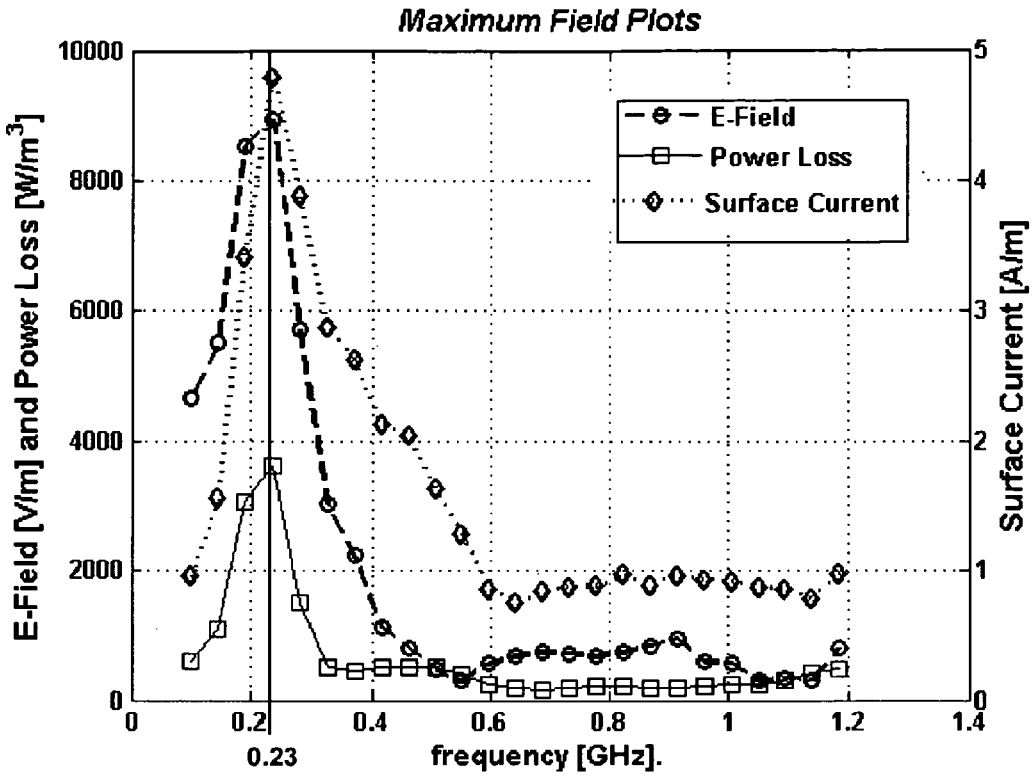
FIG. 2*f* shows simulation results for the surface current, electric field and resultant power loss density (W/m3) for the reflector of FIG. 1*c;*
Figure 2G:
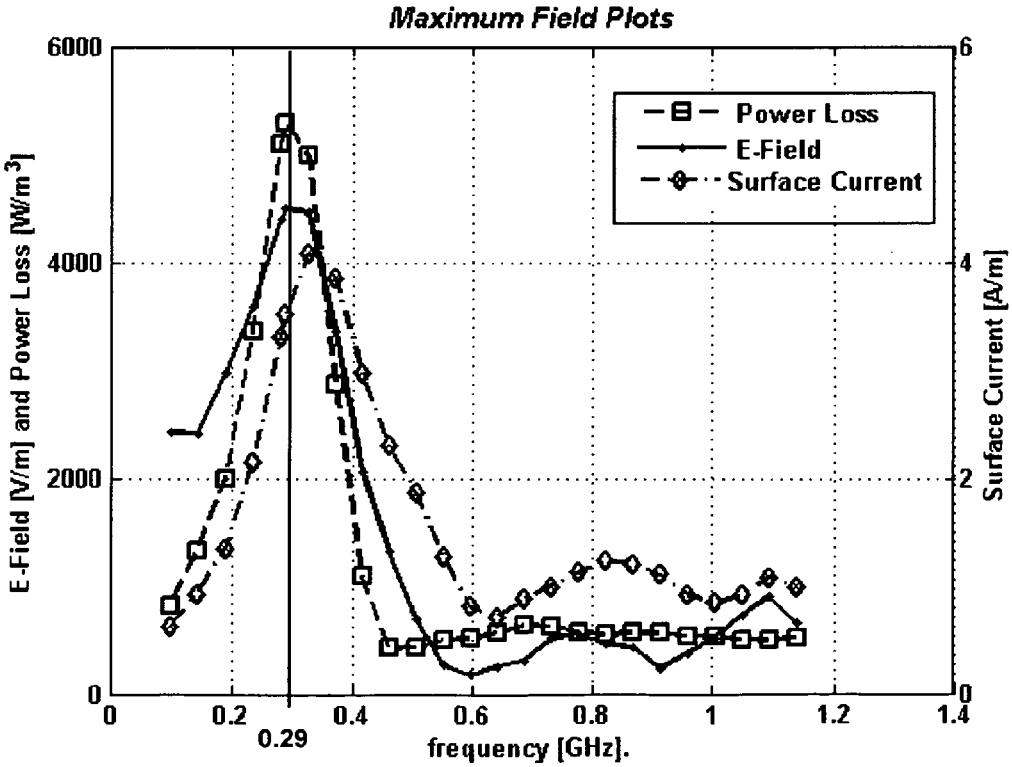
FIG. 2*g* shows simulation results for surface current, electric field and resultant power loss density (W/m3) for a reflector of length 33 cm.

FIGS. 2*a*-2*e* show simulation results illustrating the absorption due to the radiation of the passive source and the effect of distance on the delivery of RF radiation to an object near the reflector and to an object remote therefrom. FIGS. 2*f*-2*g* show variations in the respective reflective properties of two reflectors, having different proportions than the reflectors of FIGS. 2*a*-2*e*, as a function of frequency. The proper selection of the characteristics of the transmitted RF radiation (that is, the proper definition of the transmission profile) is seen to result in high energy levels within portions of object 100, while having a significantly smaller effect on the more distant object 110.

FIGS. 2*a*-2*e* show simulation results of the RF radiation delivered to objects 100 and 110 by reradiation. Higher RF radiation levels are indicated by darker shading of the object. HH The objects are presented in a cross-sectional view, from planar distances of −1.5 cm, −0.5 cm, 1 cm, and 2.5 cm. As seen in FIGS. 2*a*-2*e*, reflector 120 causes a high concentration of energy in object 100, mainly near the ends of reflector 120.

It was shown that while the RF radiation delivered to object 100 exceeds 7 kW/m3, the RF radiation delivered to object 110 rises only to 100 W/m3.

The geometry and material of the reflector and its close surroundings determine its reflective behavior as a passive source (i.e. its radiation pattern) and the coupled frequency. In the simulation it is seen that reflector 120 conforms to the expected half-dipole antenna radiation pattern, as affected by the proximity to a fatty mass.

The level of RF radiation reradiated by the reflector is frequency-dependent. Only frequencies for which the reflector is structured as a passive source will be directed from the reflector towards nearby objects.

Reference is now made to FIG. 2*f*, which shows a plot of surface current, electric field on the surface of reflector 120 and resultant power loss density (W/m3) in object 100 obtained in the above simulation. It is seen that all three variables have a maximum value at 235.6 MHz, indicating that reflector 120 is highly reflective at 235.6 MHz and corresponding to the results seen in FIGS. 2*a*-2*e*.

Reference is now made to FIG. 2*g*, which shows simulation results for surface current, electric field and resultant power loss density (W/m3) for a reflector of length 33 cm (the other conditions being identical to those described above for FIGS. 1*c*-2*f*). It is seen that this reflector serves as a passive source for frequencies of approximately 290 MHz, which are shown as non-reflective for the 44 cm. reflector of FIG. 2*f*.

FIGS. 3*a*-3*f* show simulation results of the energy directed by a reflector 320 into proximate object 300 and distant object 310 over the frequency range of 145 MHz to 371 MHz. Each figure depicts the energy reradiated by reflector 320 and absorbed in objects 300 and 310 at a different transmitted frequency. Reflector 320 is modeled as a rod of length 33 cm and a 2 cm diameter, with strong reflective properties at approximately 290 MHz. Objects 300 and 310 are modeled as fatty ellipsoids with same dimensions as described above in FIG. 1*c*. It is seen that at a cross-section of the objects (calculated at a cross-section of 0.115 m from the bottoms of objects 300 and 310 on the z-axis), the energy level in object 300 rises from about 320 W/m3 at 145 MHz to about 5.1 kW/m3 at 280 MHz, and then drops to 600 W/m3 at 371 MHz. In contrast, the energy level in object 300 remains at 0-100 W/m3 over the entire frequency band.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Figure 3A:
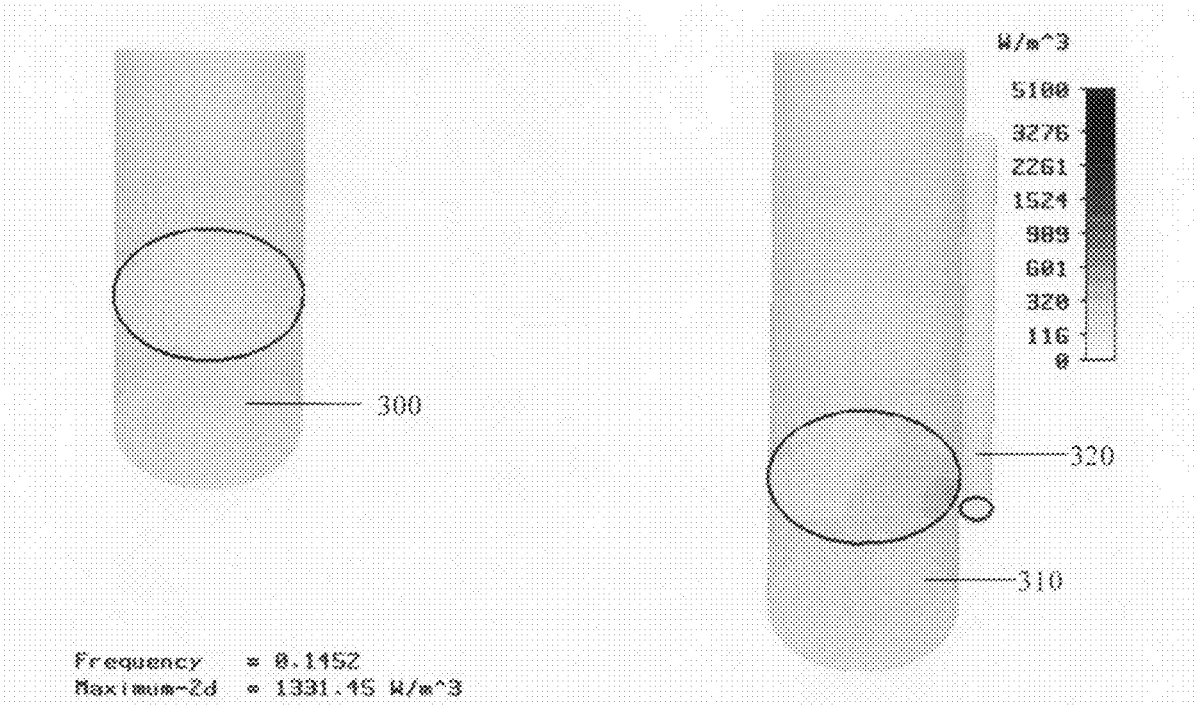
FIGS. 3*a*-3*f* show simulation results of the energy directed by a reflector into two objects over the frequency range of 145 MHz to 371 MHz.
Figure 3B:
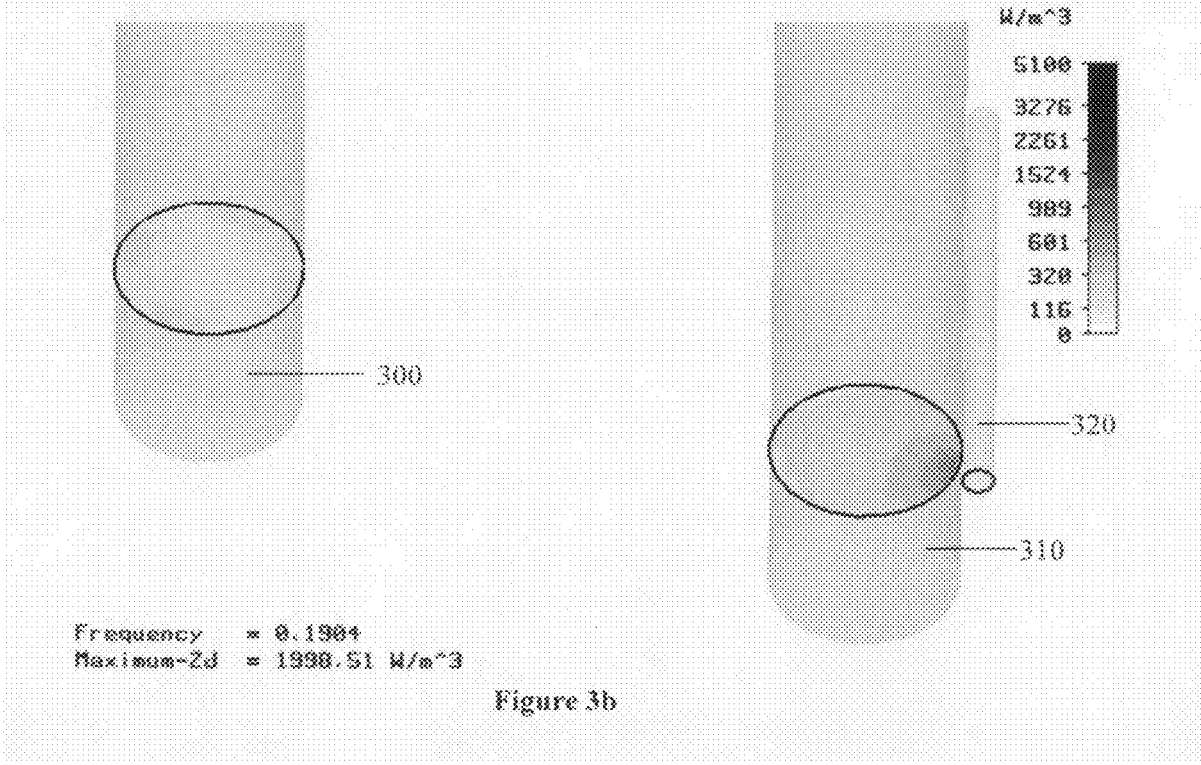
Figure 3C:
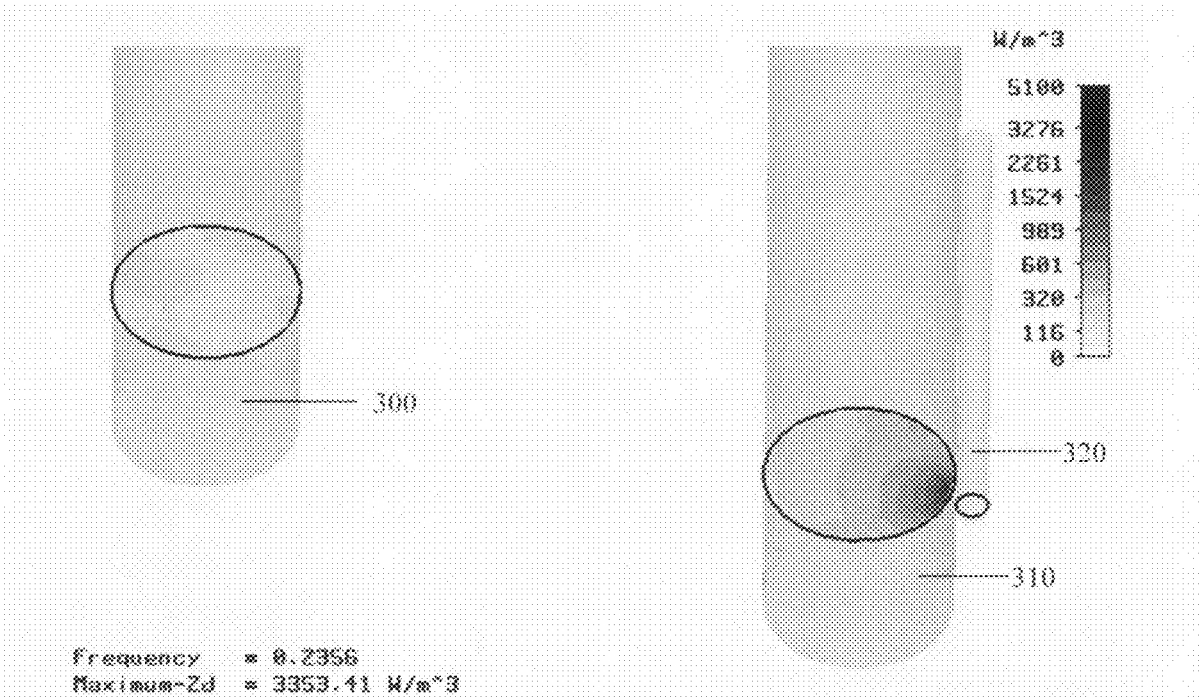
Figure 3D:
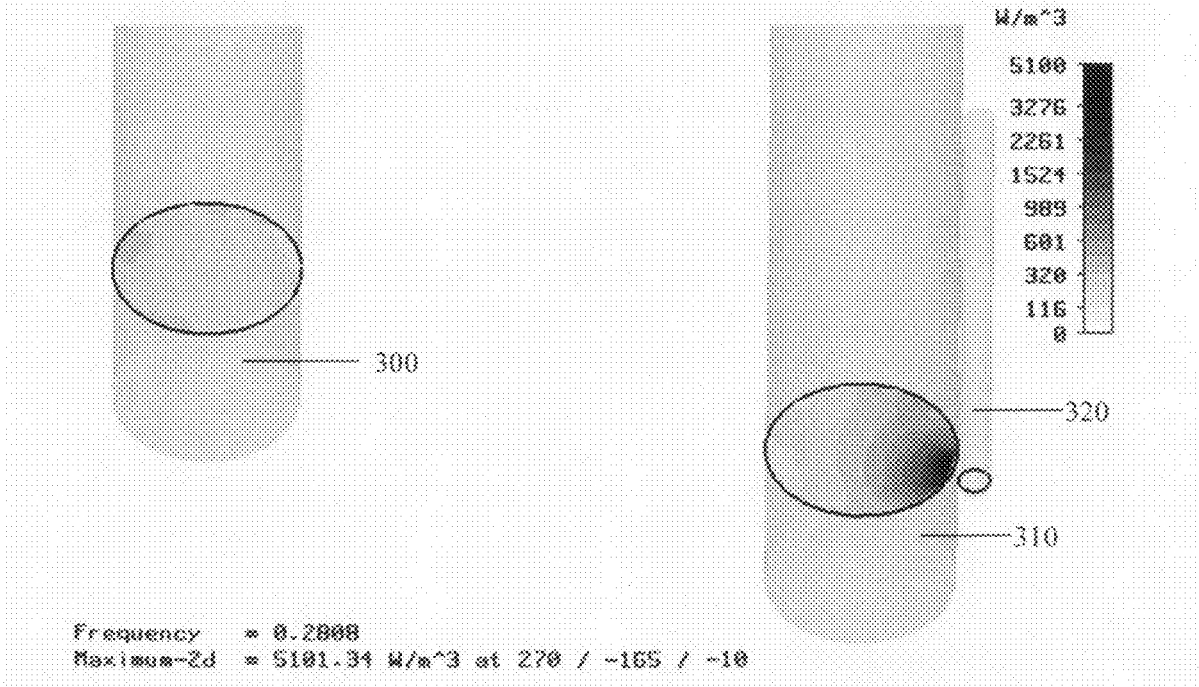
Figure 3E:
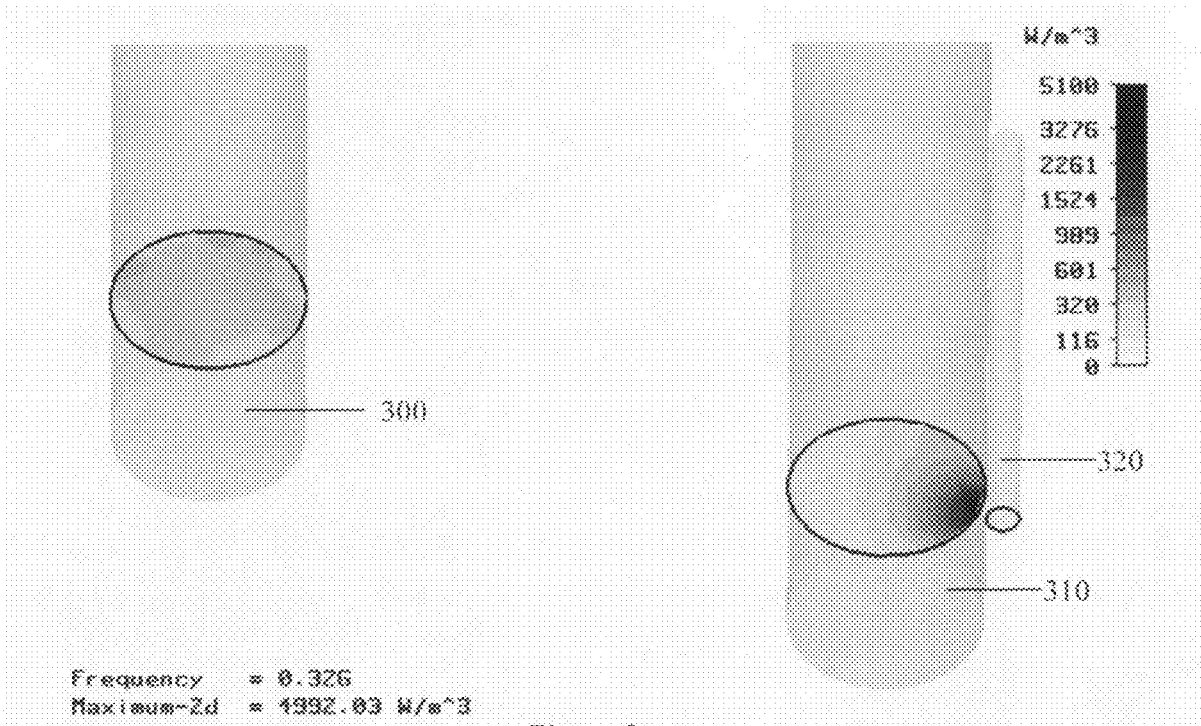
Figure 3F:
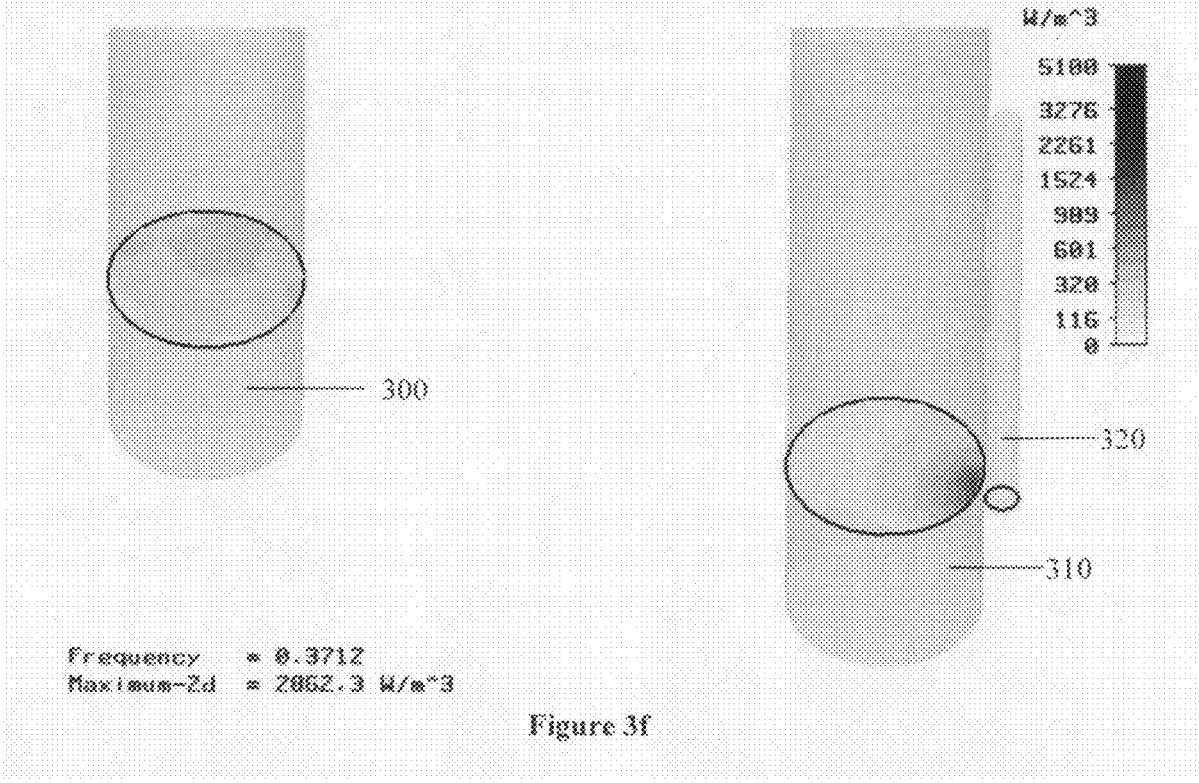
Figure 3G:
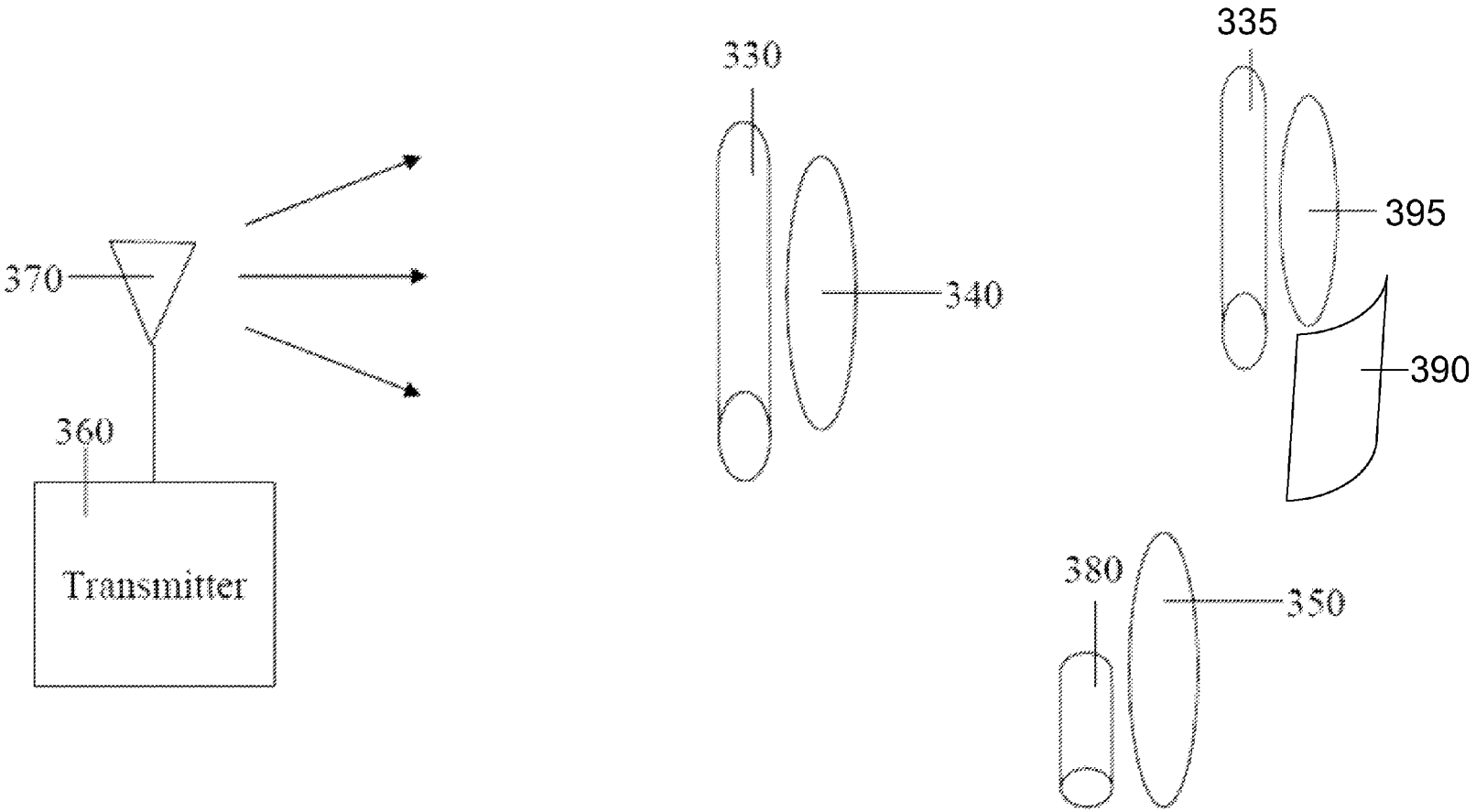
FIG. 3*g* shows a schematic representation of a location containing a target reflector and three objects.

For purposes of better understanding the present embodiments, FIG. 3*g* shows a schematic representation of a location containing a target reflector 330 and three objects 340, 350 and 395. Target reflector 330 is located in proximity to object 340 and is more distant from objects 350 and 395. In the exemplary scenario shown in FIG. 3*g* objects 340 350, and 395 are modeled as humans (as would be expected, for example, in the security embodiment discussed below). As described below, by generating and transmitting RF radiation at a resonant frequency or frequencies of target reflector 330, for example using a transmitter 360 with an antenna 370, high levels of RF radiation are reradiated towards object 340. Lower levels of RF radiation will reach object 350, in inverse proportion to the distance, depending on the reflector radiation pattern at the specific frequency and spatial conditions. Additional reflectors, such as reflectors 335 and 380, may also be present. However, if the transmitted frequency is not a resonant frequency of reflector 380, reflector 380 will not reflect RF radiation towards object 350.

Figure 4A:
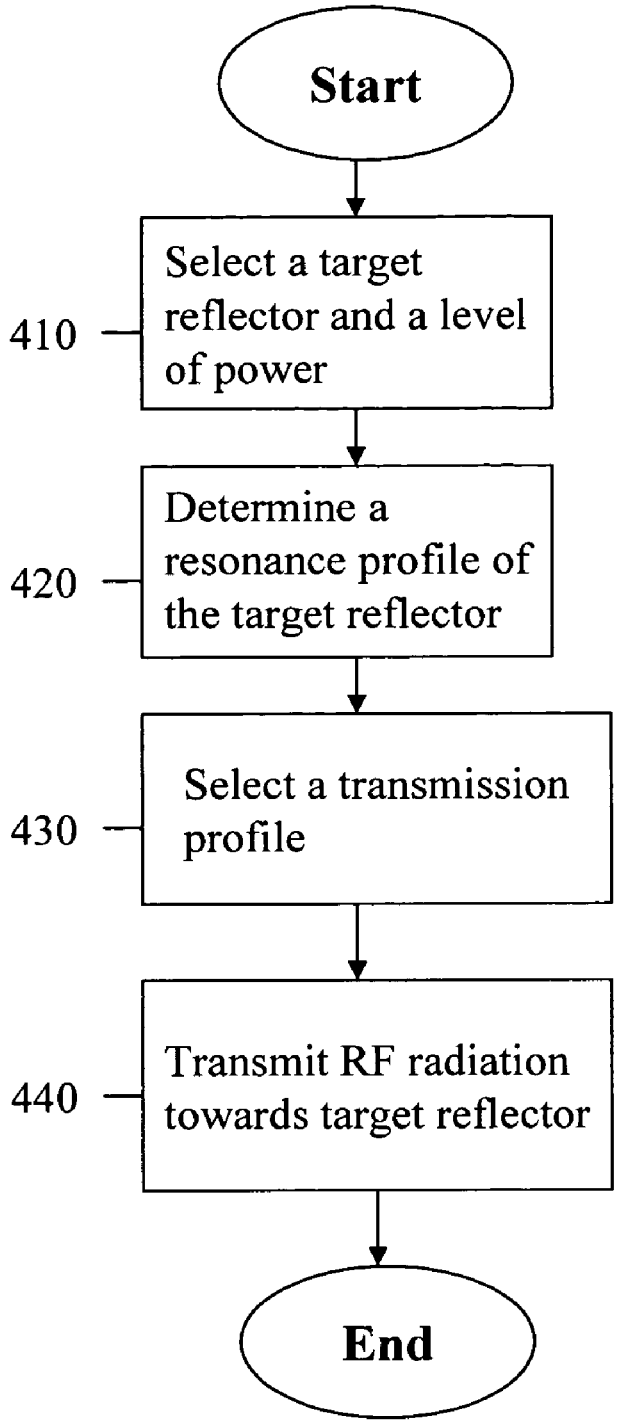
FIG. 4*a* is a simplified flowchart of a method for concentrating RF radiation on an object located in proximity to a reflector, according to a preferred embodiment of the present invention.

Reference is now made to FIG. 4*a*, which is a simplified flowchart of a method for concentrating RF radiation on an object located in proximity to a reflector, according to a preferred embodiment of the present invention. The RF radiation is concentrated on the object by transmitting RF radiation towards a target reflector in proximity to the object, so as to cause it to reradiate onto the object. The transmission frequency and power, reflector shape and type, object shape and type, and other parameters affect the amount, rate and spatial profile of energy absorption.

The present embodiments are suitable for concentrating RF radiation upon any object capable of absorbing the radiation. For example, the object may be a person or animal, or may be an inanimate object.

The capability of an object to absorb RF radiation is given by its dielectric conductivity (see Arthur Von Hippel, Dielectric Materials and Application, Artech House, pp: 3-5, 1995). Dielectric conductivity is a factor which represents angular frequency and loss factor. Dielectric conductivity sums over all dissipative effects and may represent an actual conductivity as well. In the biological literature the electrical characteristics of a tissue are generally denoted its bulk electrical properties (see K. R. Foster and H. P. Schwan, "Dielectric properties of tissues—a review", in C. Polk and E. Postow, eds. "Handbook of Biological Effects of Electromagnetic Radiation", 2nd ed., CRC press, Boca Raton, Fla., 1995).

The target reflector and the object may be in free space or may be positioned in a chamber, as long as the chamber walls do not impede the RF transmission towards the target reflector. A barrier or wall may be present between the target reflector and the object, provided it does not impede the reradiation from the target reflector towards the object. In an embodiment of the invention, the RF radiation is delivered to the proximate object via a chain of target reflectors, in which case a barrier may be present provided it does not impeded reradiation from the first target reflector to the second target reflector (and so forth) leading eventually to the absorbing object. If desired, a shielding material (see 390 of FIG. 3*g*) may be positioned relative to the target reflector to shield desired directions from the reradiated RF energy.

In step 410 a target reflector is selected, and a level of power to be conveyed to the target reflector is selected as well. The level of power is preferably selected to result in the desired accumulation of energy in a proximate object (also named herein the object or absorbing object). Note that although the target reflector may be in direct contact with the object, the target reflector and object may be physically separated, as the RF radiation is reradiated by the target reflector and therefore may also be delivered to an object which is not in physical contact with the target reflector.

In the following, the terms "proximity" and "proximate object" indicate an object within a distance from the reflector that enables the required level of power to be delivered to the objects, given the power constraints of the transmitter and antenna transmitting the RF radiation towards the reflector, and preferably in accordance with physical properties of the target reflector. Preferably, the distance between the target reflector and the proximate object is less than 1 cm, or the target reflector and proximate object are in physical contact.

In a preferred embodiment, a power level is selected such that the RF radiation delivered to the absorbing object is maximized while avoiding delivery of undesired levels of RF radiation to other bodies in the vicinity of the reflector. Such a power level may be determined by specifying a maximal level of radiation which may be delivered to the other body or bodies, selecting a transmission profile in accordance with the resonance properties of the target reflector and then calculating the level of radiation arriving at the other body or bodies. If the maximal level is exceeded, the power level(s) specified in the transmission profile are reduced until the specified maximum level is not exceeded. For example, in the security embodiments described below, a power level may be selected so that the negative effect on the assailant is maximal, with the proviso that the negative effect on an innocent is within an acceptable limit.

In step 420, a resonance profile is determined for the target reflector. The resonance profile preferably provides a respective reflection level (e.g. reflection coefficient) for multiple frequencies. The resonance profile includes at least one resonant frequency of the target reflector that is an RF frequency which will be reradiated by the target reflector in the manner described above.

The resonant frequency need not be the frequency yielding the maximum level of reflection, but any frequency having adequate reflective properties. For example any frequency having a reflection level above a specified value may be considered a resonant frequency. A resonant frequency may be one or more of:

An absolute or local resonance peak frequency

A frequency within a specified frequency band surrounding a resonance peak frequency (for example a resonant frequency may be defined as any frequency within the 3 dB bandwidth of the resonance peak)

A frequency having a transmission coefficient having a value that is below the "background" transmission coefficient by at least a specified value. The "background" transmission coefficient corresponds to the transmission coefficient that would be obtained at the same location without the target reflector present (which may be measured or estimated), or the transmission coefficient at adjacent frequencies of the sweep. For example, a resonant frequency may be defined as a frequency with return loss that is at least 3 dB greater than the response without the passive source present, or relative to other sweep frequencies.

A frequency having a transmission coefficient below a specified value, and falling within a known or anticipated frequency range, may be deemed to be a resonant frequency even if there is no resonance peak at that frequency, provided that its return loss is greater than a specified value. For example, if a resonant frequency is expected at a given frequency and the return loss at that frequency is 3 dB or more, the given frequency may be used as a resonant frequency, even if adjacent frequencies display a similar return loss.

A frequency band calculated for a specified range of $\epsilon r,eff$ (see Eqns. 1-3 below.)

A harmonic of another reflective frequency.

It may be desired to ensure that certain frequencies are not transmitted, in order to prevent reflection by non-targeted reflectors which are known or suspected to be present. For example, it may be desired to reflect RF radiation into an assailant holding a weapon, while avoiding reflection by other objects (e.g. personal items such as keys) which may be located close to other people on the scene.

Accordingly, in an optional further embodiment at least one frequency is excluded from the resonance profile. In an exemplary embodiment, the excluded frequency is selected to be a resonant frequency of a non-targeted reflector. The resonant frequency of the non-targeted reflector may be known or estimated from measurements performed as the scene (see FIG. 9*a*).

In one embodiment, RF radiation is delivered to the absorbing object via a chain of two or more reflectors. Each reflector in the chain (other than the first reflector) reradiates RF energy arriving from its predecessor, until the RF radiation arrives at the object. In the present embodiment, the resonant frequency is selected to have adequate reflective properties for all reflectors. Namely, the transmission frequency is selected to be a common resonant frequency (or harmonic) of all reflectors in the chain.

For example, in the context of a security embodiment, utilizing a chain of reflectors enables creating a passive source from a first reflector (e.g. a gun held by a first assailant) that is positioned at a location which is in communication with both the transmitting antenna and a second reflector (e.g. a gun held by a second assailant) that is nearby the absorbing object (e.g. a hostile communication device). The first passive source (the first gun) irradiates the second passive source (the second gun), which in turn directs the RF radiation onto the absorbing object (communication device).

The resonance profile may also be determined by measurement and analysis of RF radiation reflected from the target reflector, as described for FIGS. 9*a*-10 below. Alternately the resonance profile may be retrieved from a memory or database accessible by the transmitter, input by a user, or received by a data communication.

In step 430 a transmission profile which matches the resonance profile is selected. The transmission profile includes transmission at one or more resonant frequencies provided in the resonance profile.

The transmission profile provides the characteristics of the RF radiation which is to be transmitted towards the target reflector. The transmission profile preferably defines transmission parameters (e.g. combinations of power, individual frequencies and/or frequency sweeps around the resonances, a frequency band calculated for a specified range of $\epsilon r,eff$, pulse and or CW transmission, different polarizations, wait times for transmitted frequencies and other possibilities) to ensure that the reflector radiates regardless of orientation, and thus provides the desired effect on the absorbing object.

Non-limiting examples of parameters which may be included in the transmission profile are:

1. Transmission frequency—may be a specified RF frequency or frequencies, over a continuous RF frequency band, several non-continuous RF frequency bands, or any other desired definition of the transmitted frequencies.
2. Transmission power—may be uniform for all frequencies, or may vary over the transmitted frequencies.
3. Frequency dwell time—may be uniform for all frequencies (for example a constant-rate frequency sweep) or may vary over different frequencies
4. Transmission type—may be continuous wave (CW), pulsed, sweep, multiple frequency transmission or spread spectrum.
5. Direction of transmission.

In one embodiment, the transmission profile is selected by selecting a resonant frequency from the resonance profile, and calculating a transmission power required to provide the specified level of power to the target reflector. An example of how such a calculation may be performed is discussed in the context of FIG. 6 below.

In a further embodiment, the transmission profile is defined for substantially simultaneous transmission by multiple antennas (or devices). In such a case, the power transmitted from each antenna may be reduced and/or a broader bandwidth may be obtained, enabling the reduction of the weight and cost of each unit.

Preferably, the transmission profile includes a respective, dedicated profile for each transmitting antenna to enable defining separate (but coordinated) transmission parameters for each of the antennas. Moreover, the transmission profile may be defined so that two or more antennas are synchronized in phase to obtain an antenna array. A potential benefit of such an antenna array is an increase in the overall directivity of the transmitted signal.

In order to synchronize the antennas, it is preferred that each antenna is provided with the location and properties of at least one other antenna. This may be done manually, may be predetermined or calculated, or may be obtained using locating devices as known in the art (e.g. GPS or laser locators).

In an exemplary embodiment, when transmission is performed by an antenna array, one antenna unit acts as a master and regulates and/or times the activation of the other antenna units (operating as slaves). The master antenna may also indicate the placement of the slave antennas (e.g. instruct the operators to change location) and may dictate the transmission profile of each slave antenna so as to improve the performance of the array. In an alternative embodiment, the synchronization is performed in sequence, with each antenna unit being regulated by its own master and in turn regulating the activity of a slave (except for the initial master and the final slave).

The transmission profile is defined over a portion of the RF frequency band. In one embodiment the transmission profile is defined for 20 MHz to 10 GHz. In alternate embodiments the transmission profile is defined over a narrower frequency band or bands, to accommodate system considerations such as transmitter type or a specific application.

A major consideration directing the selection of a frequency span is the expected resonance of the target reflector. The required range typically depends upon the structure of the target reflector (e.g. the length in an essentially linear object), and the calculated deviation from the expected range because of near objects and other spatial considerations, such as the position relative to the active antenna. Preferably, the transmission frequency and/or other parameters such as antenna pattern are calculated from known or estimated properties of the target reflector, and, more preferably, additionally from properties of nearby bodies and/or the surrounding medium.

In a first embodiment, the transmission frequency (or frequencies) is defined within a frequency range of 20 MHz to 2 GHz, for irradiating elongated reflectors ranging in size between 8-750 cm. The frequency range of 20 MHz to 2 GHz is particularly suitable for targeting reflectors comprising weapons, such as guns or rifles or portions thereof (e.g. sights in sniper rifles). Sub-ranges may be used for more directed security embodiments. In an alternate embodiment, a frequency range of 188 MHz to 500 MHz is selected for targeting conventional guns ranging in size between 30 to 80 cm. In another embodiment, a frequency range of 100 MHz-188 MHz is selected for targeting longer guns (e.g. 80-150 cm). In yet another embodiment, a range of 600 MHz to 1.5 GHz is selected for targeting a portion of a gun (e.g. a sight piece of 10-25 cm).

In a second embodiment, the transmission frequency (or frequencies) is defined for a frequency range above 3 GHz. This range may be particularly suitable for the crowd control embodiment discussed herein, in which the reflectors may be small personal objects such as keys, watches, and jewelry.

In a further preferred embodiment, the transmitted RF radiation may be emitted in a frequency or band of frequencies close to or surrounding a known effective frequency range (e.g. +/−25% or +/−30% or less of a resonant peak frequency), such that at least a portion of the RF radiation produces a desired effect. Such a frequency or frequency band may be also derived from advance experimentation, providing an effective range to cover many deviations in position and surroundings. Although the present embodiment may be less energy efficient or less effective due to the lower levels of RF radiation which are reflected, it enables obtaining the desired effect even when the optimal transmission frequency is not known.

The resonant frequency of a given target reflector may be affected by the medium in which it is placed and by its surroundings. For example, the optimal transmission frequency for a given target reflector may differ when the target is held in close proximity to a body (e.g. a gun hanging along a holder's body) or when the target reflector is more distant from the body (e.g. the gun is placed on a table). Moreover, since it is likely that the target reflector will not have a pure rod shape, additional deviation may occur from the expected resonant frequency.

In a further embodiment of the present invention, the transmission profile is adjusted based on considerations of the target reflector's surroundings and/or shape, in order to optimize the selected transmission frequency to achieve a desired effect.

If the reflector is located in a chamber, the chamber may affect resonance properties of the reflector. In an optional embodiment, the transmission profile is adjusted based on considerations of the chamber surrounding the object.

The following demonstrates the effects of surrounding medium on the resonance of the reflector. In a simulation in free space, the resonance frequency for a rod shaped 45.5 cm reflector was 271 MHz (ff·s.). As shown in Eqn. 1, this frequency corresponds to a half wavelength dipole antenna (λ/2) with an effective length of 55.3 cm (taking into account the rod thickness and possibly its detailed structure).

$$f_{free\ space} = 271\ \text{MHz} \rightarrow \lambda/2 = \frac{c}{2\times f_{f.s.}} = \frac{3\times 10^8}{2\times 271\times 10^6} = 0.553\text{m} \quad (1)$$

In a simulation of the same rod in vicinity of fatty materials, a lower resonance frequency of 237 MHz was obtained, corresponding to an equivalent half wavelength dipole antenna of length 0.632 m:

$$f_{near\ fat} = 237\ \text{MHz} \rightarrow \lambda/2 = \frac{c}{2\times f_{n.f.}} = \frac{3\times 10^8}{2\times 237\times 10^6} = 0.632\text{m} \quad (2)$$

The correlation between the results may be shown using the effectiveness of the permittivity ($\epsilon_{r,eff}$; a dielectric property corresponding to frequency) as follows:

$$l = \frac{\lambda}{2} = \frac{\lambda_{eff}}{2} = \frac{\lambda/\sqrt{\varepsilon_{r,eff}}}{2} = \frac{\lambda/2}{\sqrt{\varepsilon_{r,eff}}} \quad (3)$$

$$0.553 = \frac{0.632}{\sqrt{\varepsilon_{r,eff}}} \rightarrow \boxed{\varepsilon_{r,eff} = 1.306}$$

$\epsilon_{r,eff}$ ranges between 1 to 5 (air and 100% fat, respectively). Inserting these values into the above formula results in:

$$\varepsilon_r = 1 \rightarrow \lambda_{min} = 1.106\ m \rightarrow f_{max} = 271\ \text{MHz}$$

$$\varepsilon_r = 5 \rightarrow \lambda_{max} = 2.47\ m \rightarrow f_{min} = 121\ \text{MHz}$$

Thus the resonant frequency may range between 121 MHz and 271 MHz under different conditions.

Figure 4B:
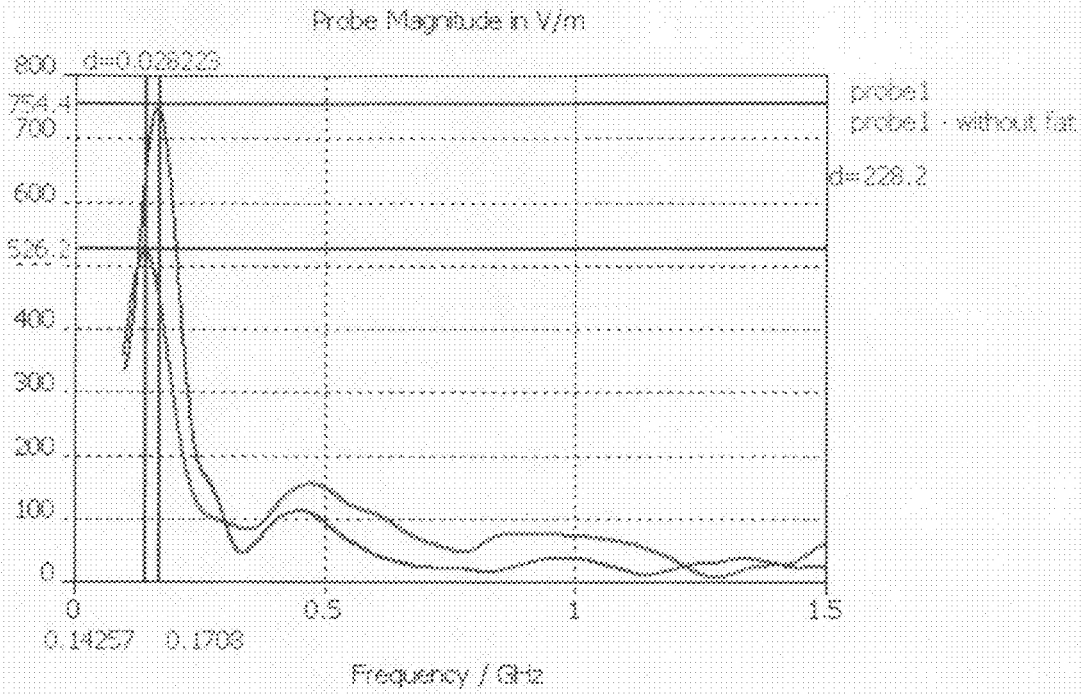
FIGS. 4*b* and 4*c* show simulation results of the resonance of a reflector in free space (without fat) and in the vicinity of a fatty mass, at a first and a second probe location respectively.
Figure 4C:
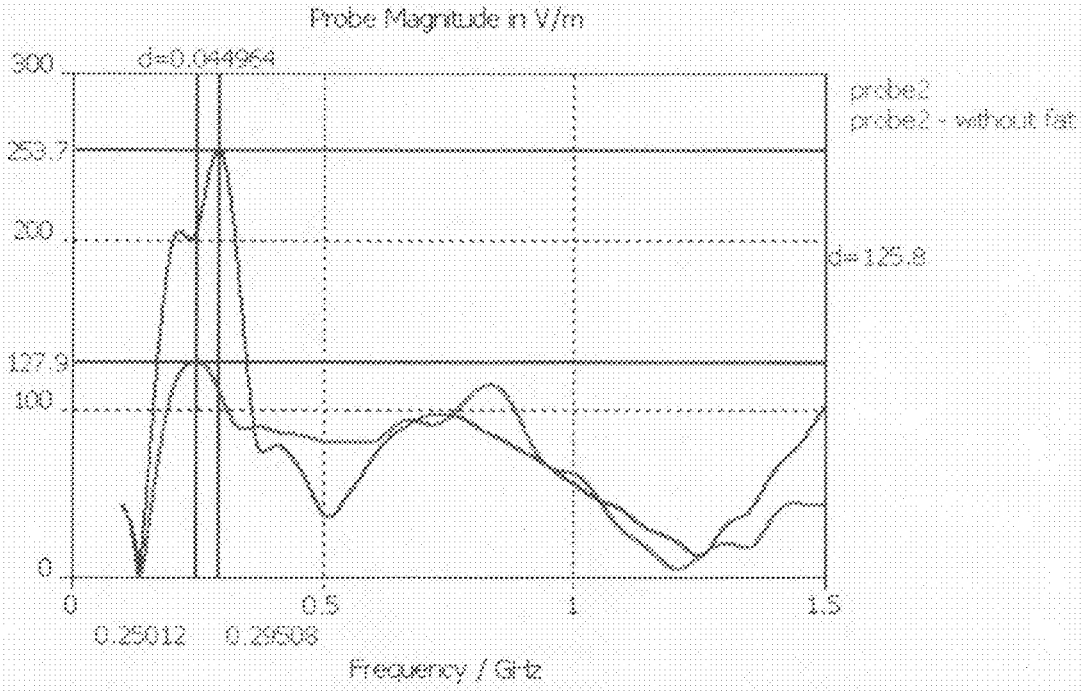

FIGS. 4*b* and 4*c* show additional simulation results of the resonance of a reflector in free space (without fat) and near a fatty material (having a length of 55.5 cm and radius of 6 cm), at a first and a second probe location respectively. The simulated reflector was a model of an AK-47 rifle having two elongated metallic portions, and a barrel approximately 65 cm in length and an inserted cartridge extending about 33 cm (see FIG. 7*a*). Probe 1 was located at the end of the 65 cm barrel and probe 2 was located at the edge of the cartridge.

The equivalent electric lengths depicted in FIG. 4*b* are 0.882 m for free space resonance and 1.02 m in the vicinity of fat.

Thus, the effective permittivity in free space is:

$$0.882 = \frac{1.02}{\sqrt{\varepsilon_{r,eff}}} \quad (4)$$

$$\boxed{\varepsilon_{r,eff} = 1.33}$$

After calculating the corresponds electric lengths of FIG. 4*c*, which are 0.508 m in free space and 0.6 m in the vicinity of fat, the following effective permittivity is obtained:

$$0.508 = \frac{0.6}{\sqrt{\varepsilon_{r,eff}}} \quad (5)$$

$$\boxed{\varepsilon_{r,eff} = 1.39}$$

It is seen that adjusting the transmission profile to account for the surroundings of the reflector may result in more efficient transmission of the RF radiation into the object.

In light of the above discussion, the present method preferably includes the further step of determining the resonant frequency in the transmission profile in accordance with one or more of the following:

1) The shape and position of the target reflector
2) The composition of the target reflector
3) The medium in which the target reflector is placed
4) The properties of a body or bodies in the vicinity of the target reflector (where the term vicinity indicates an object close enough to the target reflector to substantially affect the reflector's resonant properties). In this context, the body may or may not be the absorbing object toward which the RF radiation is directed.

The information used to determine the resonant frequency may be based on known information (such as known dimensions of a particular type of reflector), or obtained by observation or measurement.

In an embodiment of the invention, the transmission profile defines a transmission in which the transmitted RF frequency is swept across a portion of one or more of the high reflection peaks. The sweep may be over several non-contiguous bands, if more than one continuous band satisfies the criteria for the given situation.

In step 440, RF radiation is transmitted towards the target reflector in accordance with the transmission profile. The transmitted RF radiation is thus reradiated (i.e. reflected) from the target reflector. In this manner, RF radiation is directed from the target reflector into nearby objects.

In a first preferred embodiment, appropriate for example for security, crowd control and intruder repellant systems, the transmission power is set to cause discomfort to an animal in proximity to the reflector. As used herein the term animal includes humans, domestic and non-domestic animals (both mammalian and non-mammalian). The transmission power is preferably set in order to provide the desired amount of discomfort.

In a crowd control embodiment, the transmitted frequency is set to reflect off of commonly carried items such as keys, watches and belt buckles.

In an intruder repellant embodiment, a perimeter surrounding an area, or portion of the perimeter, of reflectors is established, with the reflectors having a specified transmission profile. RF radiation at the specified transmission profile is directed at the perimeter so that increasing discomfort is caused as the animal (human or otherwise) approaches the perimeter and comes into the proximity of one or more of the reflectors. The present embodiment may serve to contain an animal within a specified area, as well as to prevent predators from entering the area. Measuring the effective coefficient of reflection may allow evaluation of the size of the animal entering the area, and enable transmission only for animals of certain sizes.

Figure 4D:
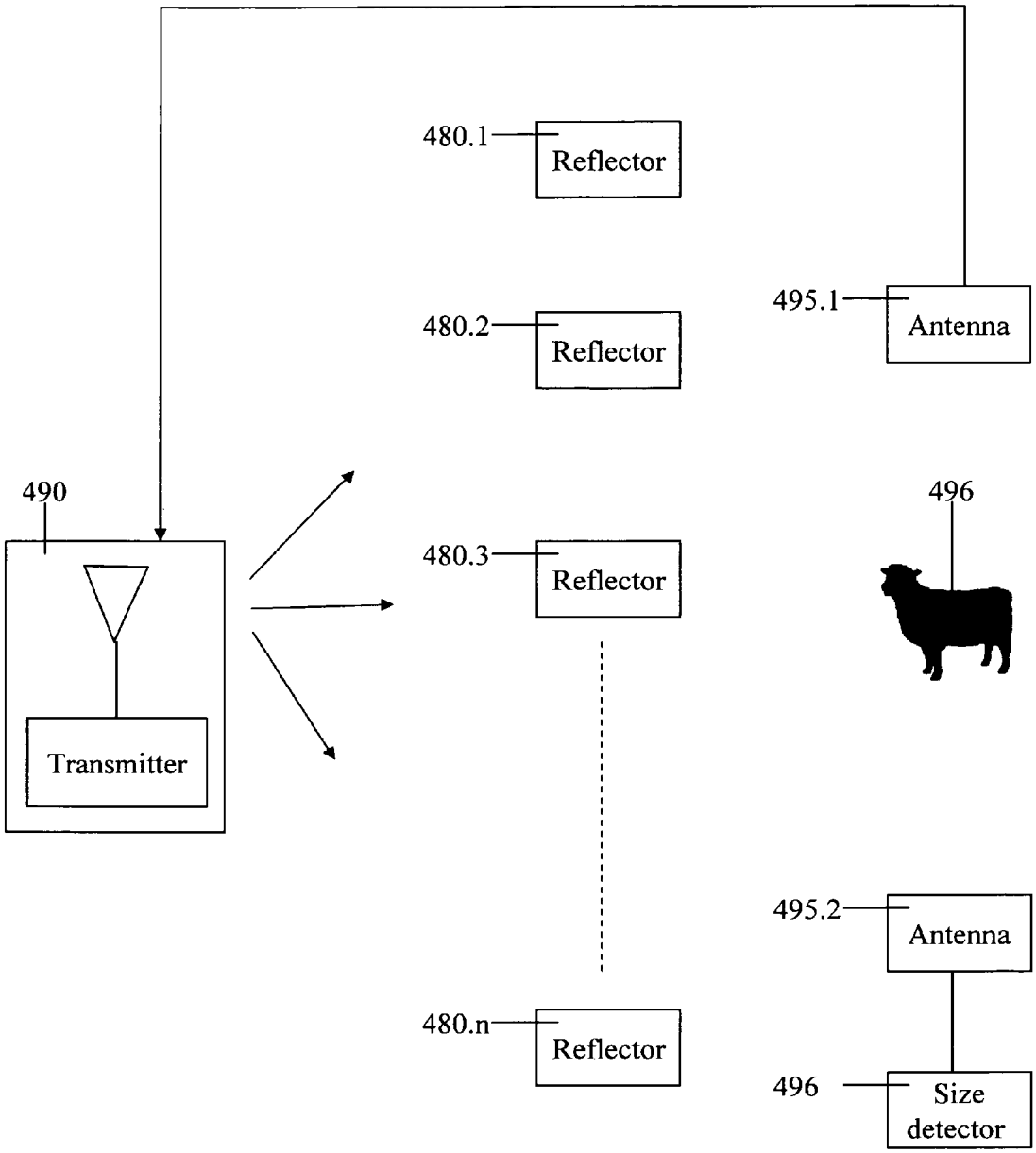
FIG. 4*d* shows an exemplary embodiment of an intruder repellant system.

FIG. 4*d* shows an exemplary embodiment of an intruder repellant system; which includes a perimeter of reflectors 480.1-480.*n* and a transmitter 490 which transmits RF radiation towards the reflectors. The RF radiation is transmitted with a transmission profile which includes a resonant frequency of each of the reflectors 480.1-480.*n*. When an animal 496 approaches the perimeter, it receives increasing levels of reflected RF radiation causing it to move away from the perimeter.

Typically reflectors 480.1-480.*n* are of the same shape and composition, and thus have a common resonant frequency. Alternately, different types of reflectors (having different sizes and/or shapes and consequently different resonance profiles) may be used in order to obtain the desired influence on the animal. In an exemplary embodiment, the different types of resonators are positioned so that an animal passing between different pairs of resonators will feel different levels of discomfort, and will therefore cross the perimeter at the desired location.

At times it is desired to activate an intruder detection or repellent system only when the intruder is a human adult or large wildlife. To that end, it is possible to add a means for detecting intruders that identifies those intruders that are to be repelled. Such detecting means may include any means known in the art, including security fences and closed observation using closed circuit cameras. An alternative detecting means comprises the use of two or more antennas coupled to one to the other across the perimeter or a portion thereof (see antennas 495.1 and 495.2 of FIG. 4*d*). When an intruder (e.g. an animal) passes between the antennas, the antennas detect RF radiation absorption which is proportionate to the size of the animal.

The size of the intruder may be calculated from the absorption data by size detector 496, for example using measurements of the input reflection coefficient 511 and/or transfer coefficients S21 to assess size, as discussed below. In a first embodiment, the system serves for intruder detection only. Notice of the intruder may be handled in any desired manner, for example by notifying a guard or sounding an alarm. In a second embodiment, the calculated size is used to select or calculate the required transmission profile. Thus an RF signal may be transmitted only when animals above a given size are detected, and ignoring small animals such as cats and dog. Upon detection of an intruder of the proper size (above a predetermined safe threshold), the RF radiation is transmitted to reflectors in the perimeter (or a relevant portion thereof) thereby causing discomfort to the intruder.

The method of transmitting RF radiation from multiple coupled antennas, measuring the absorption of the transmitted RF radiation by an object located between said coupled antennas, and determining a size (or any other parameter that may be deduced from the measurements) of the object from the measurements, is appropriate for other embodiments of the present invention in which it is desired to control the transmission based on the size of the absorbing object.

In a security system embodiment, the transmission power is set to cause pain to a human in proximity to the target reflector, as described below. A power level may be selected so that the negative effect on the assailant (i.e. magnitude of RF radiation delivered to the assailant) is maximal, with the proviso that the negative effect on an innocent is within an acceptable limit. It is however suggested that at times a minimal damage to an innocent would be acceptable in order, for example, to save his life.

In an additional preferred embodiment, appropriate for example for a heating system (see below), the method includes the further step of setting the transmission power to heat the object. The transmission power is set so as to cause a temperature rise in the object, preferably to a desired value and/or at a desired rate. Preferably, the temperature of the object itself is measured, and the transmission profile is adjusted in accordance with the measurements, so as to obtain the desired temperature increase.

In a preferred embodiment, an initial step of placing one or more target reflectors near the object is performed. This step is suitable, for example, in the heating system embodiment. The target reflector(s) may be shaped, positioned and constructed of a material so as to obtain a required EM energy absorption pattern, such as uniformity throughout the object. For example, if the reflector is not made from a perfect conductor the RF radiation directed at the reflector will cause the reflector temperature to rise. The reflector will then heat the object by both RF radiation heating and conduction heating.

Other embodiments do not require the placement of the target reflector, but rather utilize an already present reflector, for example in the security system embodiment. In a first embodiment, the transmitter location is fixed. The transmitter transmits an RF signal having a selected transmission profile. When a reflector which is reflective at a currently transmitted frequency or frequencies approaches the transmitter, the reflector reradiates the transmitted RF radiation with increasing levels as the reflector comes closer to the transmitter.

Alternately, an existing reflector may be utilized by determining the location of the target reflector (and optionally the object as well), and positioning the transmitter in accordance with the determined locations.

Figure 5A:
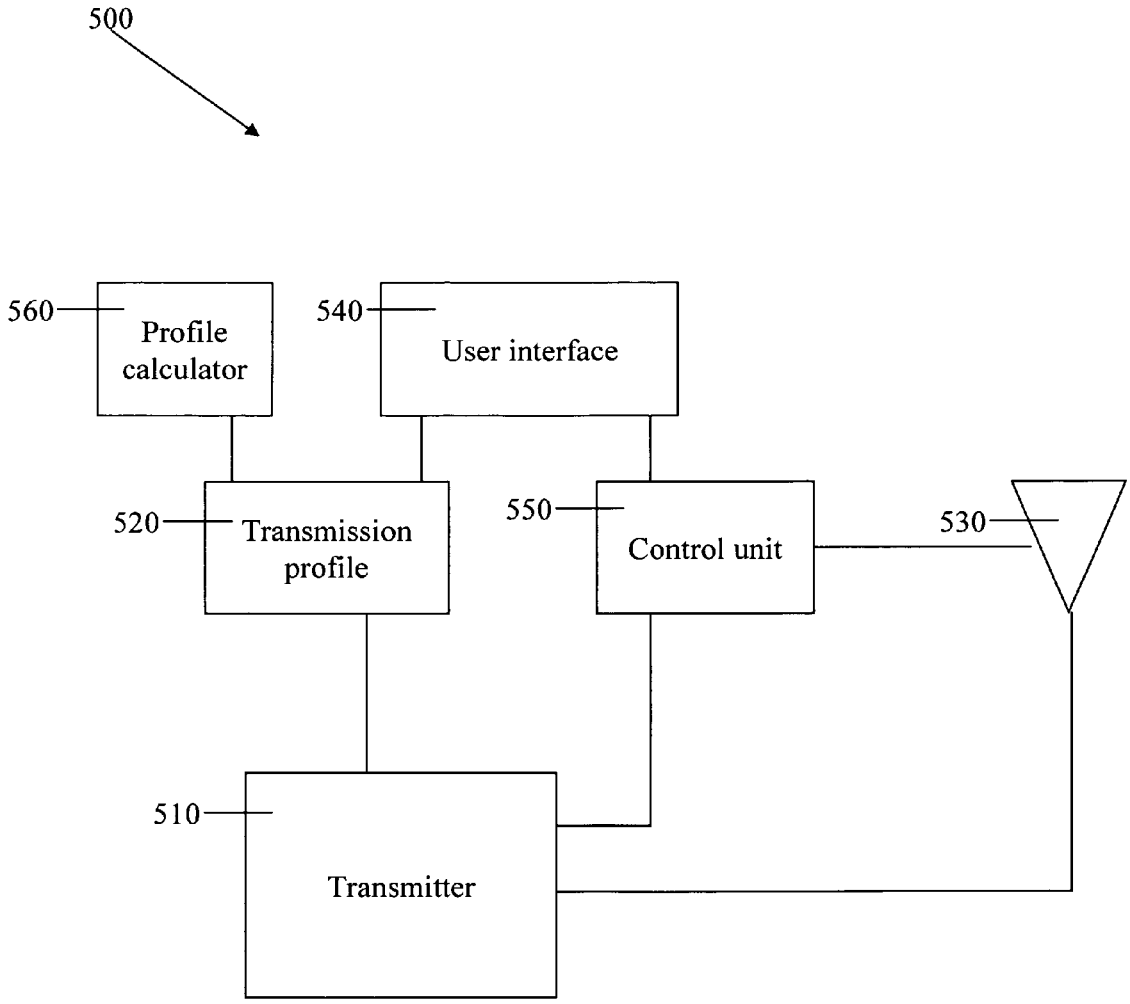
FIGS. 5*a* and 5*b* are simplified block diagrams of a wireless transmission system for concentrating RF radiation on an object located in proximity to a reflector, according to a first and second preferred embodiment of the present invention respectively.

Reference is now made to FIG. 5*a*, which is a simplified block diagram of a wireless transmission system for concentrating RF radiation on an object located in proximity to a reflector, according to a first preferred embodiment of the present invention. Transmission system 500 includes transmitter 510 and antenna 530. During operation, transmitter 510 transmits RF radiation (also named the RF signal) in accordance with the parameter values provided in transmission profile 520, so that the transmitted RF signal is reradiated by the target reflector. Antenna 530 is selected to be appropriate for transmission of the RF signal defined by the transmission profile, and may, for example, be a reflector antenna or an antenna array.

Transmitter 510 may be a wideband transmitter, providing a flexible, generalized system. Alternately transmitter 510 may be a narrowband transmitter suitable for transmission at the frequency or frequencies of the transmission profile (e.g. a magnetron), possibly resulting in a simplified system in terms of price, size and efficiency. Transmitter 510 may be continuous wave (CW) or pulsed (which may utilize a lower power amplifier compared to CW with similar results).

Transmitter 510 preferably includes an RF signal generator and amplifier, which are designed to provide an output RF signal having the required frequency characteristics and output power, in accordance with transmission profile 520 and other system constraints.

Transmission system 500 may also include a control unit 550 and/or user interface 540. Control unit 550 controls the transmitter components (such as an RF signal generator or RF amplifier) and/or antenna 530, so as produce and transmit the required RF frequencies at the desired power, as defined by the transmission profile 520. User interface 540 gives the user the ability to control the transmission system and/or to specify or modify transmission profile 520. Control unit 550 and/or user interface 540 may also participate in sweep measurements to obtain information regarding the target reflector, by the process described for example in FIGS. 9*a*-10 below.

In an embodiment, transmission system 500 further includes profile calculator 560, which serves to calculate and/or update the transmission profile. This calculation may be based on measurements (e.g. of absorption an absorptive object in the vicinity of the target reflector), externally provided information (e.g. properties of objects known to be near the target reflector) and/or information stored in a database.

In a preferred embodiment, transmission system 500 includes multiple antennas for substantially simultaneous transmission. Coordinated transmission with multiple antennas (each denoted an "antenna unit") may increase the gain. In order to synchronize the antenna units, it is preferred that each antenna unit is provided with the location and properties of at least one other antenna unit. This may be done manually or using locating devices as known in the art (e.g. GPS or laser locators). Preferably, each antenna unit (and/or associated transmitter) is associated with a communication unit enabling communication and coordination with a central controller and/or between the multiple antenna units. Optionally, each antenna may transmit independently, however when the need arises the antennas may be coordinated into an array (for example when greater range is required for radiating towards a distant target reflector).

Figure 5B:
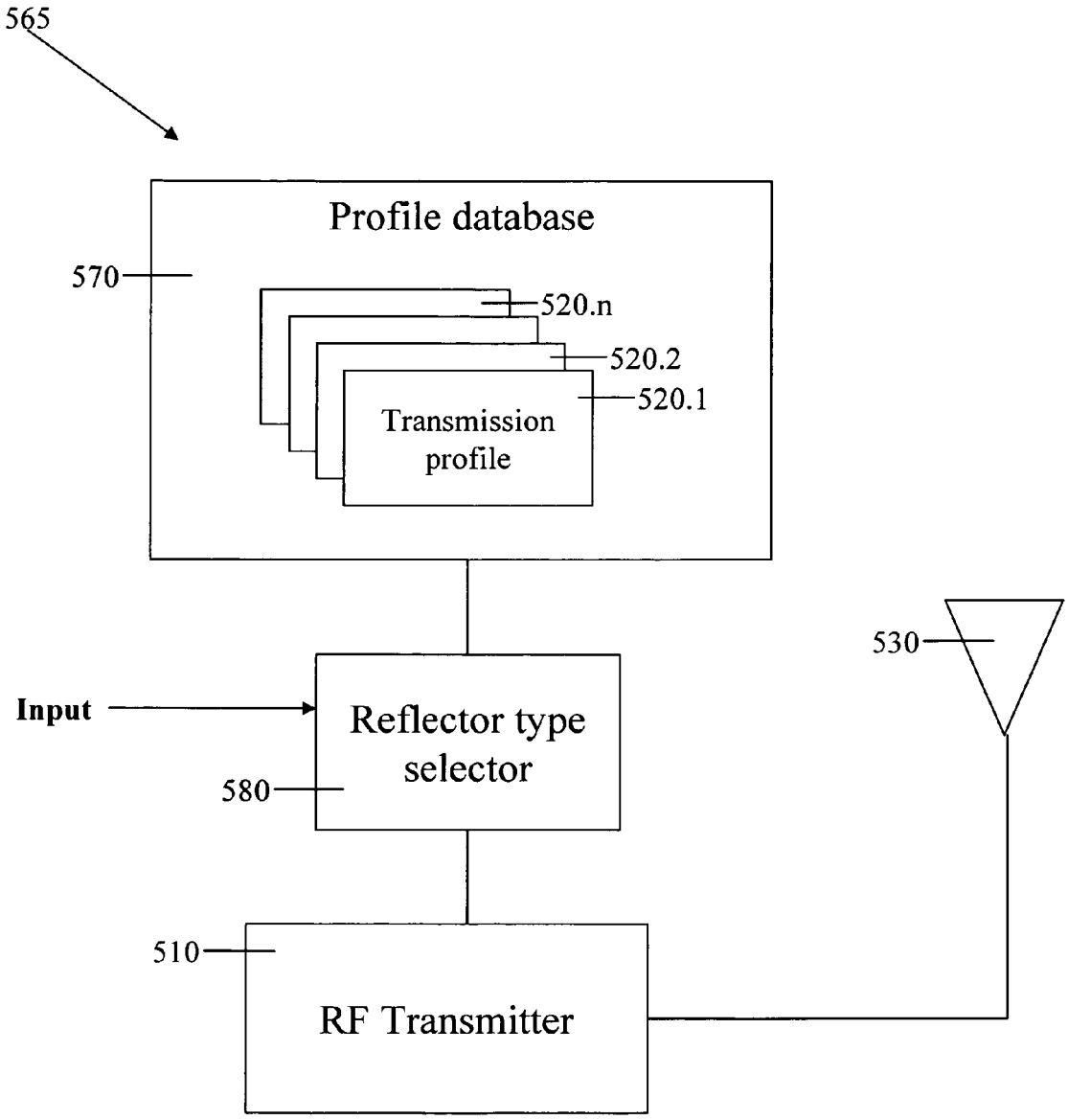

Reference is now made to FIG. 5*b*, which is a simplified block diagram of a wireless transmission system for concentrating RF radiation on an object located in proximity to a reflector, according to a second preferred embodiment of the present invention. In the present preferred embodiment transmission profiles are stored in a profile database, and the appropriate transmission profile is selected prior to transmission.

Transmission system 565 includes transmitter 510, profile database 570 and reflector type selector 580. Profile database 570 stores a respective transmission profile for multiple types of reflectors, 520.1 to 520.*n*. Each transmission profile is adapted to result in reradiation by a target reflector of the respective type based on its resonance profile, and includes at least one resonant frequency of the respective type of reflector.

Prior to transmission, reflector type selector 580 selects one of the reflector types and provides the respective transmission profile to transmitter 510, for transmission towards a target reflector. The reflector type is preferably selected based on input from a user control interface of a data interface, or based on an analysis of measured reflections obtained from the target location prior to transmission of the RF signal (see FIGS. 9*a*-10).

Transmission system 565 preferably further includes an antenna 530 for transmission of the RF signal towards the target reflector.

The RF transmitter and antenna should together provide the necessary combination of transmitter output power, and antenna gain and directionality to provide the desired amount of energy to the object, as determined by the user, the application, the system type or by simulation results.

RF amplifiers suitable for embodiments of the present invention are commercially available, and include for example the KAW5120 RF amplifier by AR RF/Microwave Instrumentation which provides 2000 Watts CW at 200 MHz-500 MHz. A second available amplifier is the SMCC-3000 amplifier by IFI Inc., which provides 3000 Watts at 200-1000 MHz. Both are mountable in standard 19 inch racks. In an alternative example, a traveling wave tube (TWT) may be used as the amplifier with 70% efficiency, small size and high power. Other amplifiers may be used as well.

Figure 6:
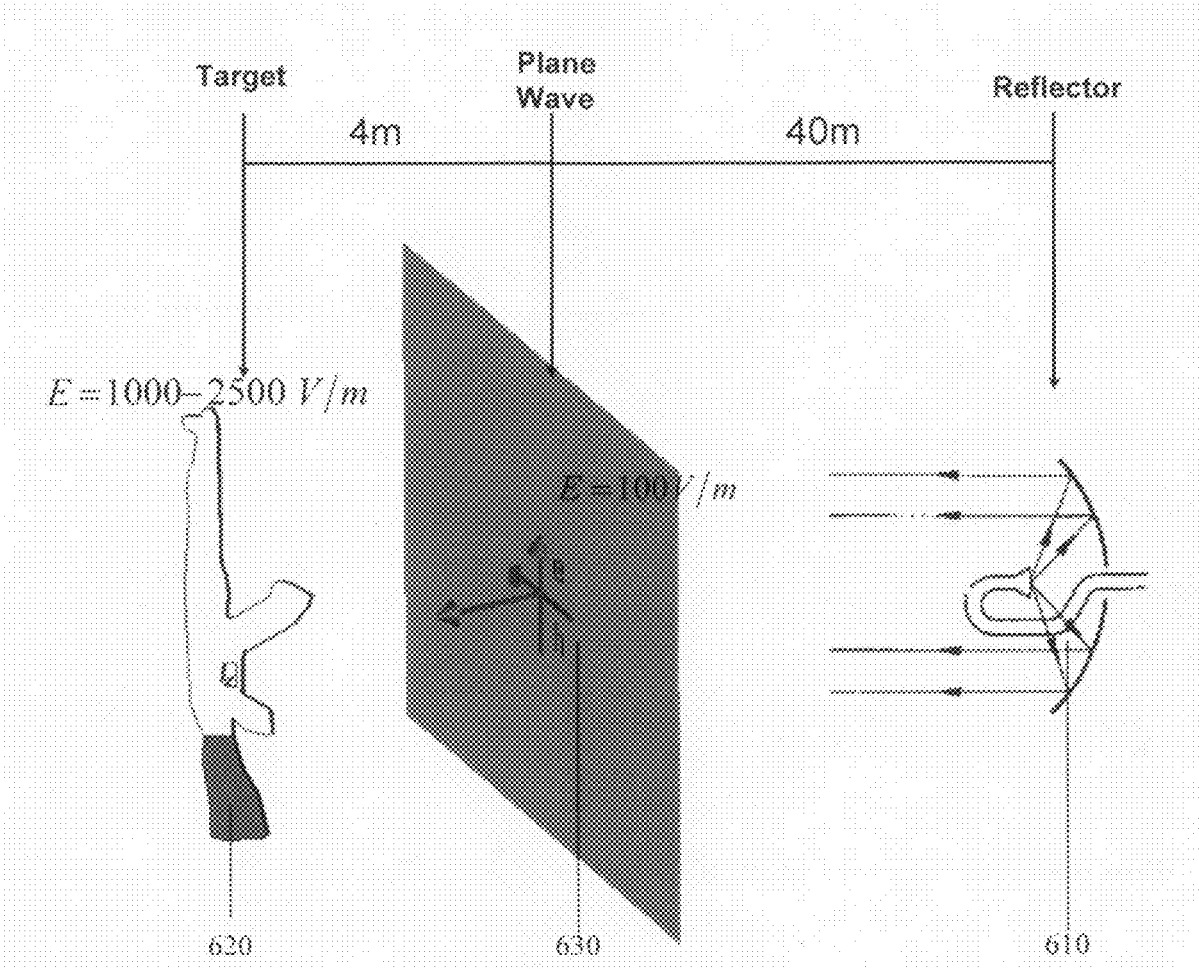
FIG. 6 is a schematic representation of an exemplary system with a parabolic antenna transmitting towards a target reflector.

Antennas suitable for embodiments of the present invention are known in the art, and include parabolic antennas which exhibit a highly-directional response with reasonably sized reflectors. Reference is now made to FIG. 6, which shows an exemplary system having a parabolic antenna 610 transmitting an 800 MHz wave at a distance of 44 meters from target reflector 620. The following shows a calculation of the transmitted power PT required in order to produce a plane wave having an electric field strength of E=100 V/m at a distance of four meters from target reflector 620. Note that, given a reflector gain of about 10 to 13 dBi (decibel from isotropic radiation pattern), the electric field at the reflector's edges will range between approximately 1000 to 2500 V/m. The gain of parabolic antenna 610 may be approximated as:

$$\text{Gain}_{Parabolic\ Dish} = 0.6\left[\frac{4\pi A}{\lambda^2}\right]_{A=\frac{\pi D^2}{4}} = 6(D/\lambda)^2 \quad (6)$$

Assuming that the antenna gain is 22 dB (equals 158.4), the antenna diameter is given by:

$$D = \lambda\sqrt{\text{Gain}/6} = \frac{3\times10^8}{8\times10^8}\sqrt{158.4/6} = 1.927\text{m} \quad (7)$$

Thus the required parabolic antenna has a radius of 0.96 meters.

The power of the plane wave 40 m. from the transmit antenna is:

$$P_d = \frac{E^2}{120\pi} = \frac{100^2}{120\pi} = 26.5\ W/m^2 \quad (8)$$

The power density given in Eqn. 8 above equals a transmitted power times the gain of the transmitting antenna, and divided by the inverse square of the distance, which may be written as:

$$P_d = P_T\frac{G}{4\pi R^2} \quad (9a)$$

The required transmitter output power may be calculated as:

$$P_T = P_D\frac{4\pi R^2}{G} = \frac{26.5*4\pi*40^2}{158.4} = 3.3\ \text{KW} \quad (9b)$$

The above-described method and system may be utilized in situations in which it is desired to disarm a person holding a weapon. The metallic portions of the weapon are utilized as a reflector having a known or determinable resonance profile, and a corresponding transmission profile is defined. An RF signal with the weapon's transmission profile is transmitted toward the weapon, causing it to reflect.

The reflection from the weapon directs a high level of RF radiation into the person holding the weapon causing immediate and intense pain and/or muscle contraction. Persons more distant from the weapon are affected very little, if affected at all, provided they are distant enough from the target reflector so that the levels of reradiated RF energy they absorb are below a level which causes significant pain or discomfort. (If significant pain or discomfort are caused these might be considered acceptable for a particular situation.) This security system is particularly appropriate for hostage situations, where it is desired to disarm the person holding the weapon without hurting hostages (who are not holding a weapon). Examples of reflective weapons include firearms and knives.

In the preferred embodiment, a wireless transmission apparatus for concentrating RF radiation on an object located in proximity to a reflective weapon (named herein a security system) is structured similarly to the transmission system of FIG. 5*a*. The security system includes a weapon transmission profile and a transmitter, and preferably further includes an antenna. The weapon transmission profile is adapted to a resonance profile of a reflective weapon, and includes at least one resonant frequency of the reflective weapon (i.e. passive source). The weapon resonance profile may be determined by simulation, lab tests or any other technique known in the art.

The transmitter transmits RF radiation towards the target weapon in accordance with the weapon transmission profile. The RF radiation reflects off the weapon (which serves as a passive source) into the body (e.g. causing significant neural stimulation and/or heating) of the person holding the weapon (or in proximity to the weapon), creating pain and causing the assailant to drop the weapon within a very short time (almost instantaneously) compared to other known ways of disarming persons holding weapons. The reflected RF radiation may also cause a temporary paralysis.

In a further preferred embodiment, the security system includes a database of weapon transmission profiles for respective weapon types (as in FIG. 5*b*). If the weapon type held by the assailant is known, the user may select a weapon type from the database, transmit RF radiation based on the respective weapon transmission profile, and thus disarm the assailant. The security system may include a power adjuster, for adjustment of the transmission power based on the distance from the assailant, the amount of pain it is desired to cause and other factors.

Reference is now made to FIGS. 7*a*-7*e* which present simulated results of the operation of a security system, where an assailant is holding an AK-47 rifle.

Figure 7A:
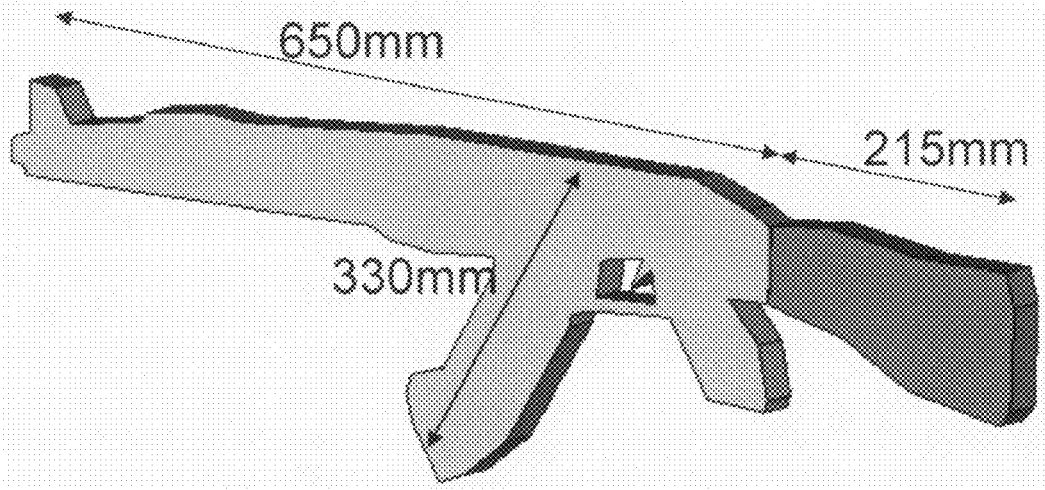
FIG. 7*a* is a schematic representation of an AK-47 rifle.

FIG. 7*a* is a schematic representation of an AK-47 rifle which has a reflective portion of length 650 mm. It was determined by simulation that the AK-47 is reflective at a frequency of about 145-155 MHz (and its harmonics) when in close proximity with a fatty object (e.g. an assailant).

Figure 7B:
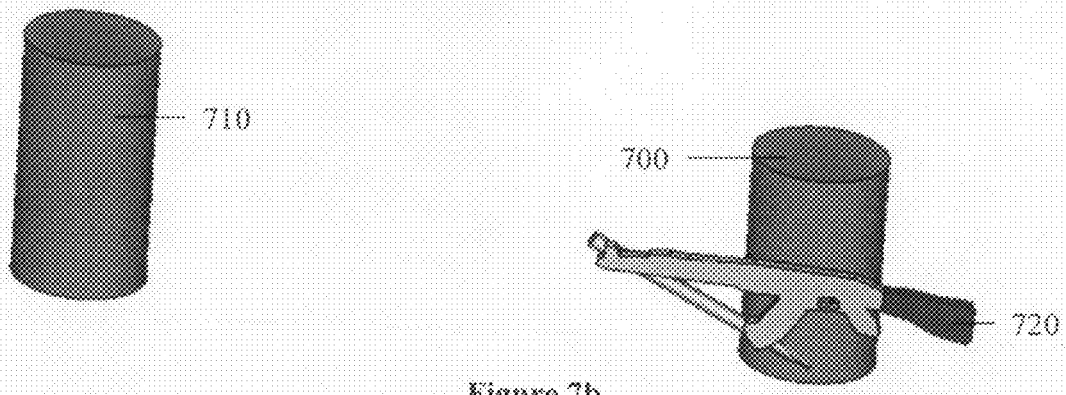
FIG. 7*b* is a schematic figure showing the relative positions of an assailant and a hostage.

FIG. 7*b* is a schematic figure showing the relative positions of the assailant 700 and the hostage 710. Assailant 700 is depicted in a crouching position holding AK-47 rifle 720.

Figure 7C:
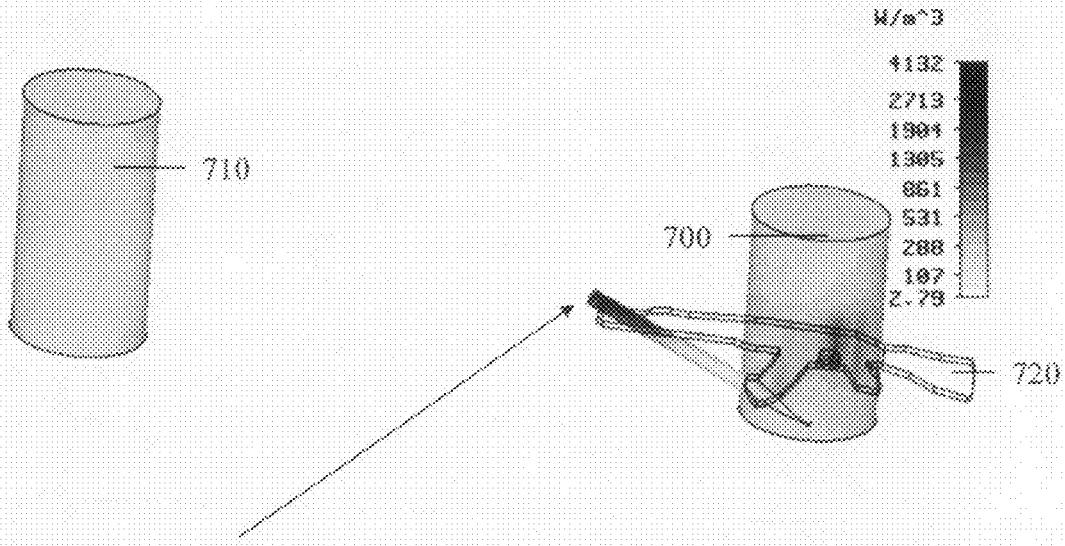
FIG. 7*c* shows a power loss density (W/m3) in the assailant and hostage during RF transmission.

FIG. 7*c* shows simulation results of the power loss density (W/m3) in assailant 700 during the transmission of RF radiation at 145 MHz and arriving at rifle 720 at a power density of 24.5 W/cm2. It is seen that hotspots having a high power loss density (W/m3) (up to 6.7 KW/m3) are present in assailant 700, whereas there is only a minor effect on hostage 710. This hotspot will cause immediate and extreme pain in assailant 700, causing assailant 700 to discard the rifle 720.

Figure 7D:
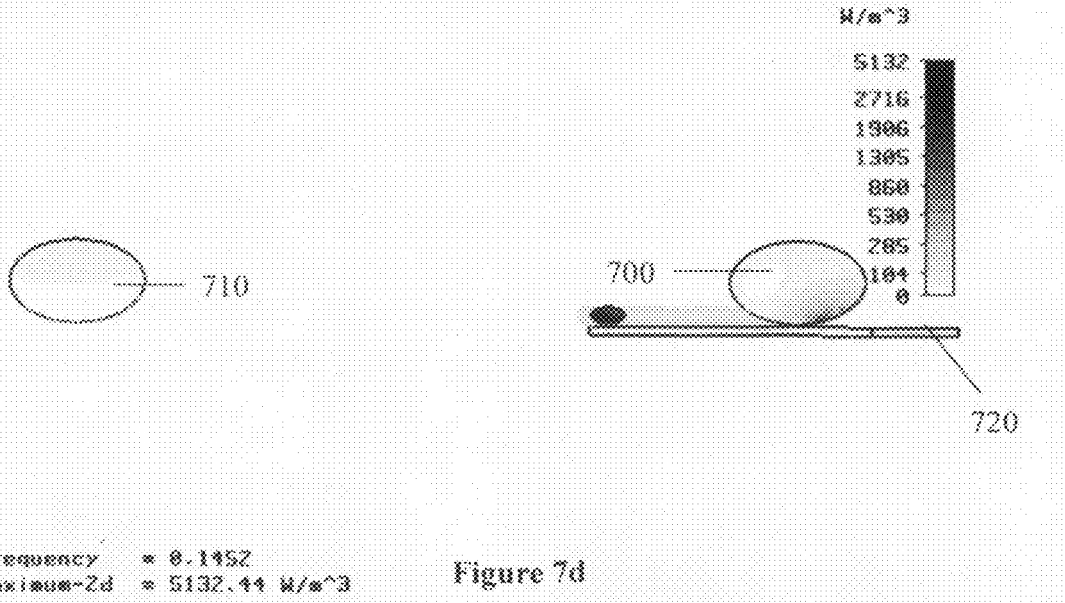
FIG. 7*d* shows a power loss density ($W/m^3$) in the assailant and hostage during RF transmission in a two-dimension cut plane of a top view.
Figure 7E:
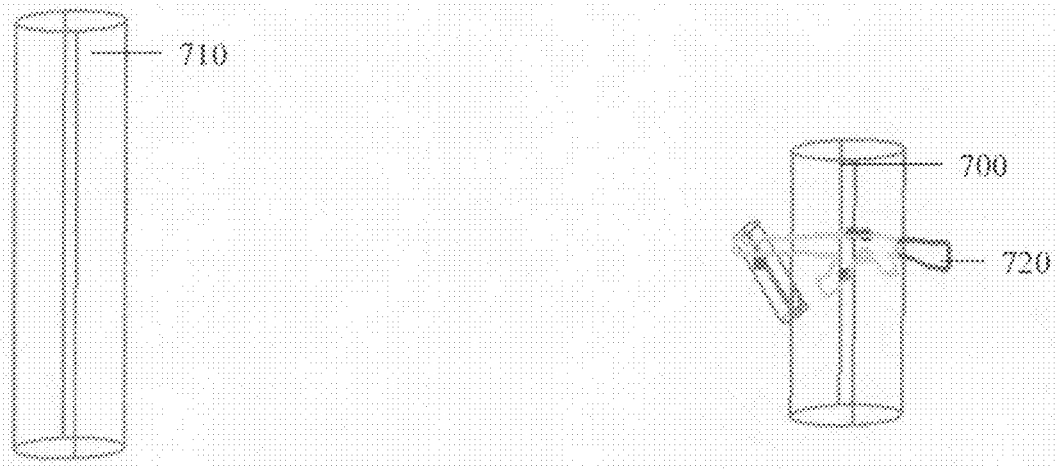
FIG. 7*e* shows the equivalent hot spots in the assailant and hostage during RF transmission.
Figure 7F:
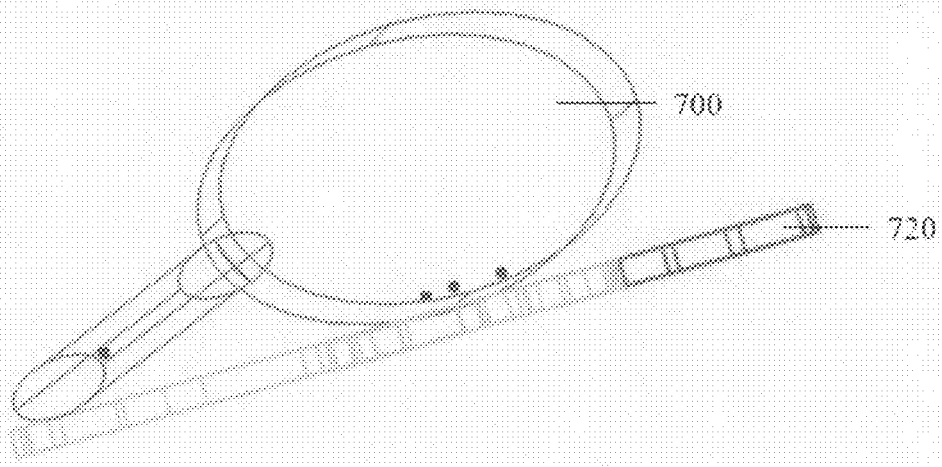
FIG. 7*f* shows a top view of hot spots in the assailant during RF transmission.

FIGS. 7*d*-7*f* are schematic drawings showing the hotspot locations relative to rifle 720. FIG. 7*d* shows a power loss density ($W/m^3$) in the assailant and hostage during RF transmission in a two-dimension cut plane of a top view. FIG. 7*e* shows the equivalent hot spots in the assailant and hostage during RF transmission. FIG. 7*f* shows a top view of hot spots in the assailant during RF transmission.

In one embodiment the security system is portable, and may be transported to the required location (for example on a truck or other vehicle). Portable power amplifiers and antennas able to provide the required frequencies and power are available (see above).

In an alternate embodiment, the apparatus is handheld, for situations in which a smaller distance from the assailant enables using a lower-power device.

Another preferred embodiment of the present invention is a heating method and system. A reflector (or reflectors) of a known shape and size is positioned within a space (such as a warehouse). RF energy having a suitable transmission profile for reradiation by the positioned reflector, and at a power level which will provide comfortable heating, is radiated towards the space. The reflected radiation heats objects in the proximity of the positioned reflector. It is therefore not necessary to heat the entire space in order to heat the objects within the space.

Figure 8:
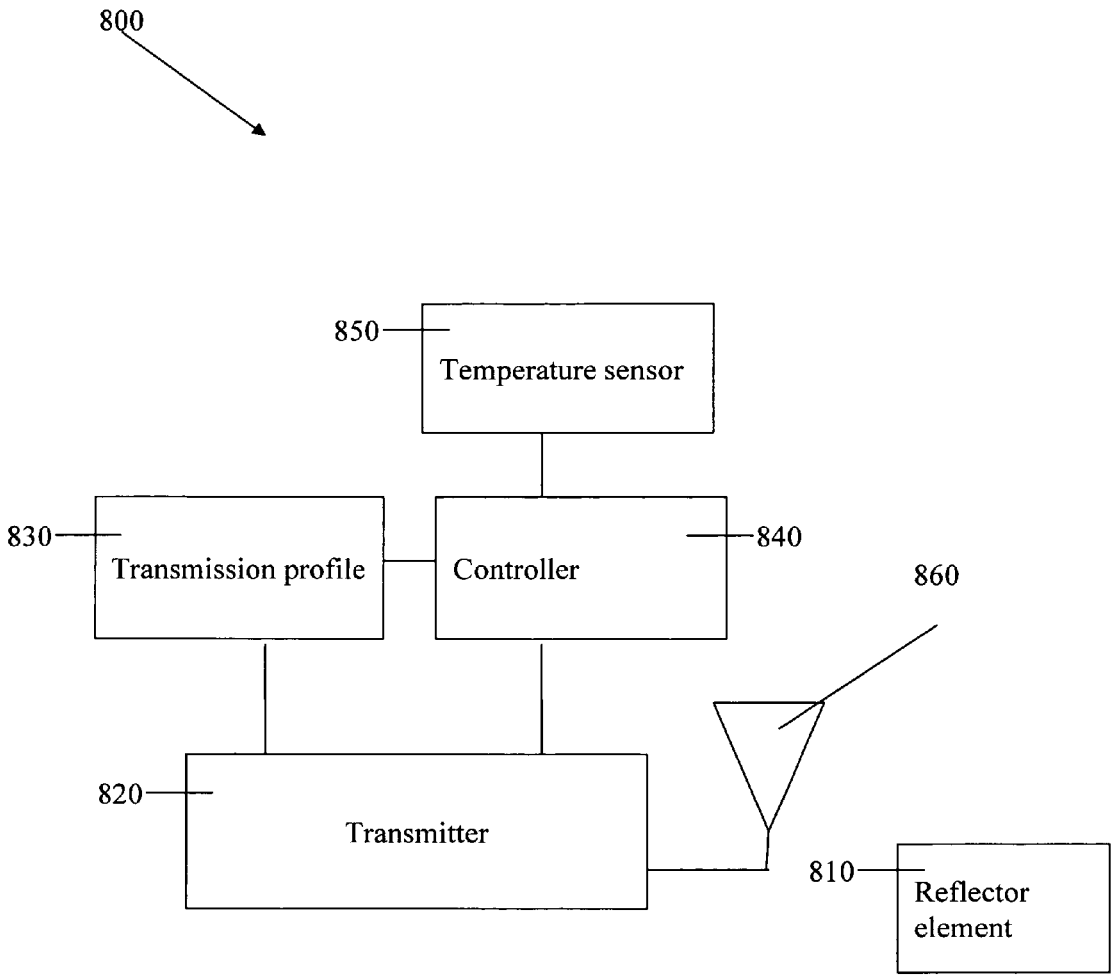
FIG. 8 is a simplified block diagram of a heating system, according to a preferred embodiment of the present invention.

Reference is now made to FIG. 8, which is a simplified block diagram of a heating system according to a preferred embodiment of the present invention. Heating system 800 includes at least one reflector element 810, transmitter 820 and antenna 860. The reflector element 810 is shaped and structured to be positionable in proximity to the object to be heated, and to have the desired resonance profile that will reflect at the frequencies transmitted by transmitter 820. Transmitter 820 transmits RF radiation in accordance with a transmission profile 830 which is determined from the resonance profile of reflector element 810, so as to create a desired heating pattern. The reflected RF radiation creates a heating effect on objects in proximity to reflector element 810.

In a further preferred embodiment, heating system 800 further includes controller 840, which serves to adjust the transmission profile during transmission of the heating RF signal by transmitter 820. Controller 840 may also serve for other system control purposes. Controller 840 may be adjustable directly by the user via a user interface, via a data interface or by any other method known in the art.

Preferably controller 800 adjusts the transmission profile, and consequently the heating effect, in accordance with measurements obtained from temperature sensor 850, thus forming a feedback system. Temperature sensor 850 may be positioned in contact with an object being heated.

The above-described embodiments are based on transmission of an RF signal defined by a transmission profile, and which includes at least-one resonant frequency of the target reflector. It is therefore necessary to have some knowledge of the resonance profile the target reflects. The following embodiments enable the determination of the resonance profile of a reflector present at a scene. The embodiments may be utilized when the resonance profile is not known a-priori or during transmission, to determine the effectiveness of the transmission and to detect changes.

Figure 9A:
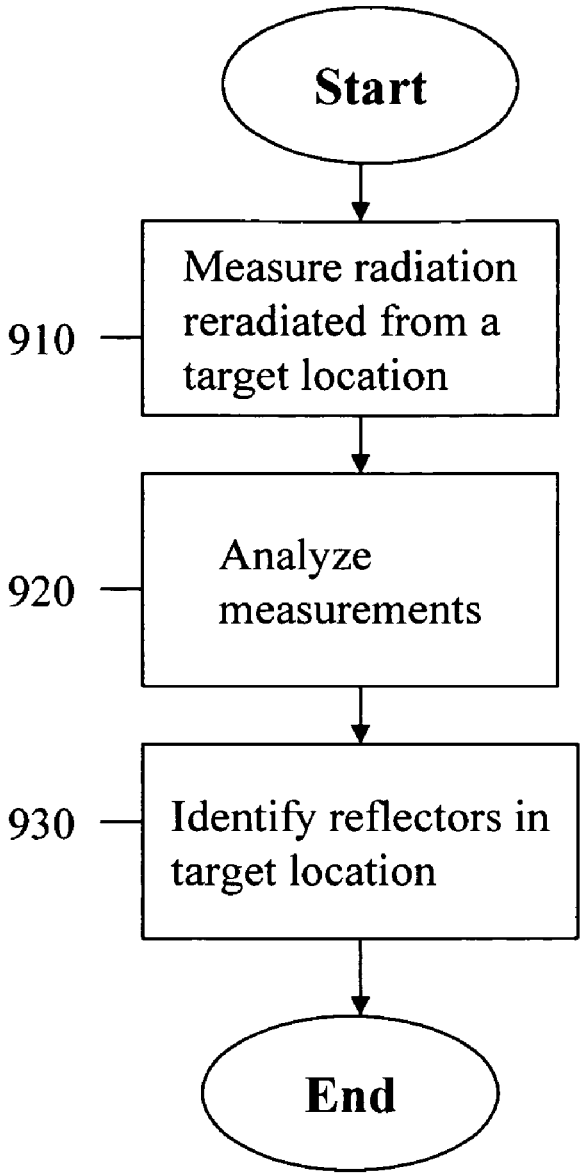
FIG. 9*a* is a simplified flowchart of a method of determining a resonant profile of a reflector in a target location, according to a preferred embodiment of the present invention.

Reference is now made to FIG. 9*a*, which is a simplified flowchart of a method of determining a resonant profile of a reflector in a target location, according to a preferred embodiment of the present invention. These steps may be performed prior to and/or during the method of FIG. 4*a*.

In step 910 radiation reradiated (or scattered) from a target location is measured over a plurality of frequencies. The measurement may be done using two measurement antennas. The coupling between the two measurement antennas is reduced at frequencies reradiated by reflector(s) in the target location. The measurement is preferably performed by transmitting multiple RF frequencies towards the target location, typically at low power, and measuring the reflected radiation. In a first exemplary embodiment the transmission is a sweep waveform transmission over a specified RF frequency band or bands. In a second exemplary embodiment the transmission is a pulse transmission which generates RF radiation over a specified RF frequency band.

Measurements used for the analysis may also be performed from additional locations. For example, the input reflection coefficient S11 and/or the transfer coefficients S21 may both be measured during the transmission.

In step 920 the measurements are analyzed to determine at least one resonant frequency of a target reflector located within the target location. Resonance frequencies of passive sources in the target space are more strongly coupled, and will therefore have a lower reflected power. The analysis takes into account the relative locations at which the measurements are made relative to the transmitter, and the close proximity to an absorbing object.

The method preferably further includes step 930 of identifying a reflector or reflectors located in the target location. For example, matching harmonics of a given frequency may be converted into an approximate length, and thus can serve to separate between different objects.

In an additional preferred embodiment, the method of FIG. 9*a* is incorporated into a method which defines a transmission profile based on the measured resonance profile of the target reflector.

Figure 9B:
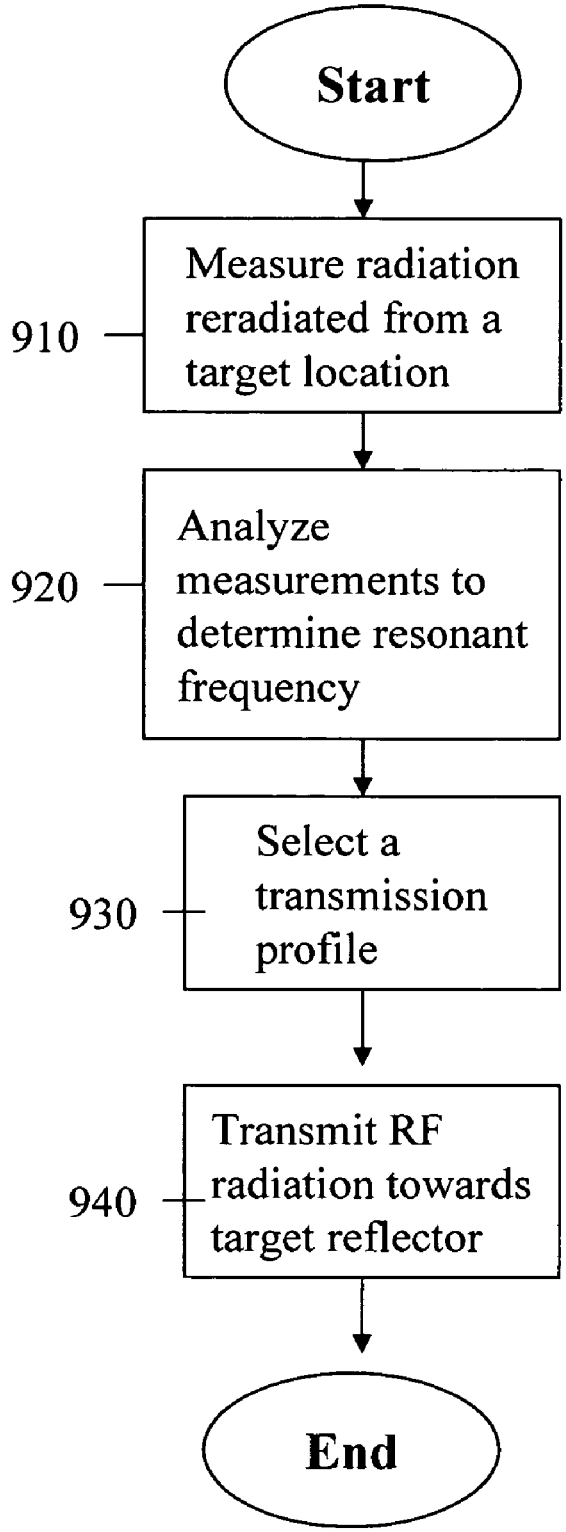
FIG. 9*b* is a simplified flowchart of a method for adapting an RF transmission to a reflector located within a target location, according to a preferred embodiment of the present invention.

Reference is now made to FIG. 9*b*, which is a simplified flowchart of a method adapting an RF transmission to a reflector located within a target location, according to a preferred embodiment of the present invention.

Steps 910 and 920 are performed as above, to determine at least one resonant frequency of a target reflector located at the target location. In step 930 a transmission profile is defined based on the results of the analysis, where the transmission profile includes at least one of the resonant frequencies determined by the analysis. In step 940, RF radiation is transmitted towards the target location in accordance with the defined transmission profile.

Figure 10:
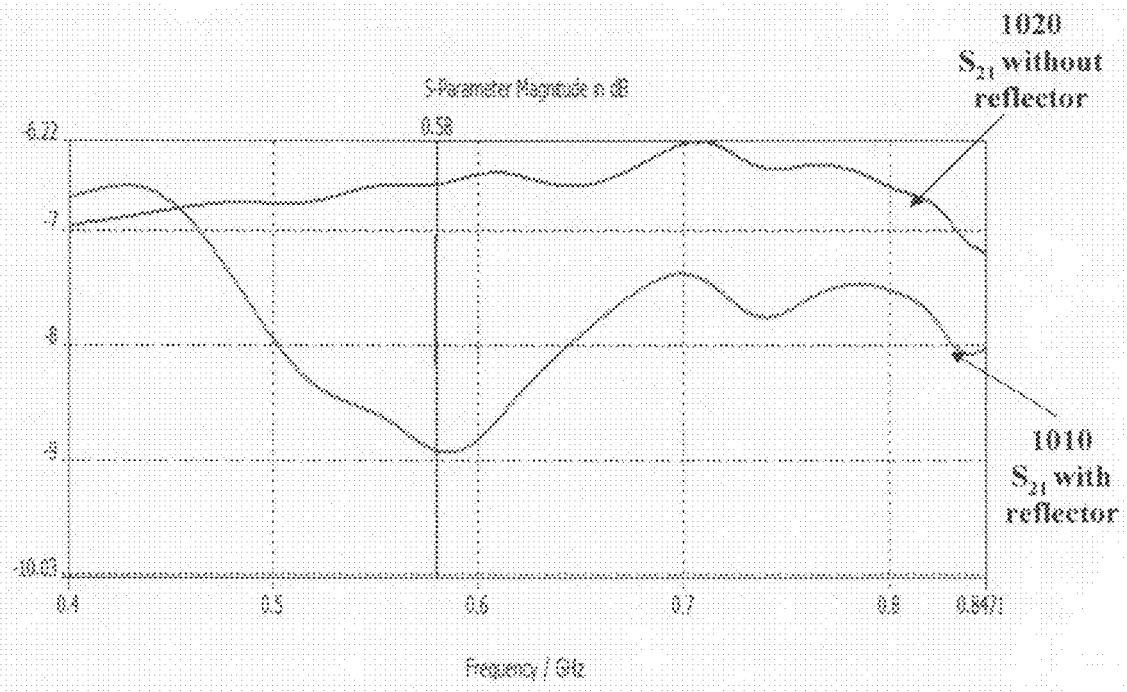
FIG. 10 shows simulation results of the S21 coefficients between two ports with and without a 20 cm. passive resonator.

FIG. 10 shows simulation results of the values of the S21 coefficient measured between two ports, both with a reflector present 1010 and without a reflector present 1020. The coefficients are shown over a frequency range of 0.4 GHz to 0.847 GHz. It is seen that there is a relatively uniform level of coupling between the ports when the reflector is not present 1020. With the reflector present 1010 there is relatively weak coupling at 0.58 GHz, indicating that in the presence of the reflector less energy arrives at the coupled port. The coupled frequencies may be used to estimate the dimensions of the object between the ports, and, further, to identify the type of object. A similar identification process may be based on the S11 reflection coefficient.

It is noted that the resonances of a reflector change according to the proximity of the passive source to the object. If the properties of the target reflector are known, it is possible to determine whether there is an absorbing object in proximity to the target reflector by transmitting RF radiation with coupled antennas and identifying resonances. The identified resonances may then be compared to the known resonant properties of the reflector. The deviation of the measurements from the expected results provides information about absorbing objects near the reflector. In the security embodiment, for example, knowing the weapons available to the assailant, it may be possible to determine whether the weapon is near the assailant (e.g. the assailant is holding the weapon) or far from the assailant.

Figure 11:
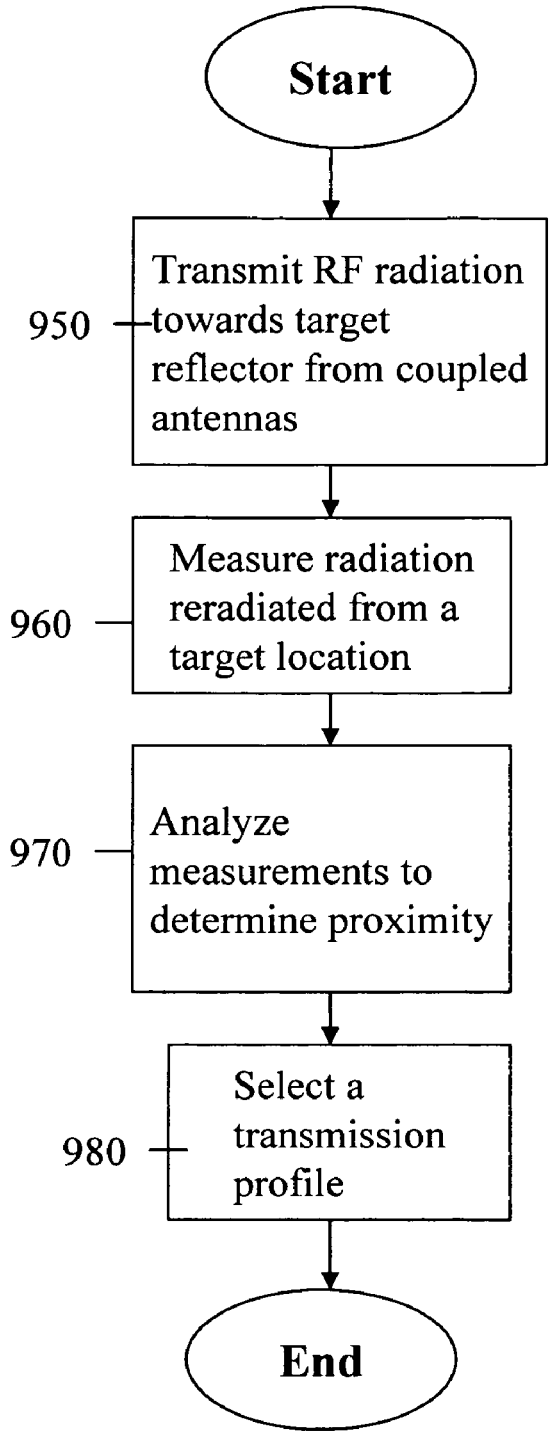
FIG. 11 is a simplified flowchart of a method for determining the proximity of an object to a reflector, according to a preferred embodiment of the present invention.

Reference is now made to FIG. 11, which is a simplified flowchart of a method for determining the proximity of an object to a reflector, according to a preferred embodiment of the present invention. In step 950 RF radiation is transmitted towards the reflector from coupled antennas. In step 960, the reflected RF radiation is measured. In step 970, the proximity of an object to the reflector is determined by an analysis of the measurements. In a further embodiment, the transmission profile is selected, based on the determined proximity (and other factors). For example, a higher transmission power may be selected when the object is more distant from the reflector (e.g. when the dielectric constant that influences the resonance is closer to the dielectric of air, $\epsilon=1$) than when it is close to the reflector (e.g. when the dielectric constant that influences the resonance is closer to the dielectric of fat, $\epsilon=5$).

It is expected that during the life of this patent many relevant transmitters, transmission techniques and parameters, antennas, reflectors and reflectivity analysis methodologies will be developed and the scope of the corresponding terms is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A method for transmitting radio frequency (RF) radiation, comprising:

selecting a target reflector;

determining a resonance profile of said target reflector, said resonance profile including at least one resonant frequency of said target reflector;

transmitting RF radiation from a plurality of coupled antennas;

measuring absorption, of said transmitted RF radiation, by an object located in proximity to said target reflector;

determining a size of said object from said measurements; and selecting a transmission profile matching said resonance profile in accordance with said determined size, said transmission profile comprising said at least one resonant frequency; and transmitting RF radiation in accordance with said transmission profile towards said target reflector.

2. A method according to claim 1, wherein said selecting a transmission profile comprises specifying a transmission power for said transmitting.

3. A method according to claim 2, wherein said specifying a transmission power comprises setting said transmission power to one of:

a transmission power which provides a specified level of power to said target reflector;

a transmission power which provides a specified level of radiation to said object via reradiation from said target reflector;

a transmission power which maintains a level of radiation provided to a second object below a specified limit;

a transmission power which discomforts an animal in proximity to said reflector; and a transmission power which heats said object.

4. A method according to claim 2, wherein said specifying a transmission power comprises setting said transmission power to one of:

a uniform transmission power for all frequencies included in said transmission profile; and a respective transmission power for a plurality of transmitted frequencies.

5. A method according to claim 2, wherein said specifying a transmission power comprises setting said transmission power to a transmission power which causes pain to a human in proximity to said reflector.

6. A method according to claim 1, wherein said transmission profile is defined over a portion of the RF frequency band.

7. A method according to claim 6, wherein said portion of the RF frequency band comprises at least 20 MHz to 10 GHz.

8. A method according to claim 6, wherein said portion of the RF frequency band comprises at least 20 MHz to 2 GHz.

9. A method according to claim 6, wherein said portion of the RF frequency band comprises frequencies greater than 3 GHz.

10. A method according to claim 1, wherein said resonant frequency comprises a resonance peak frequency.

11. A method according to claim 1, wherein said resonant frequency comprises a frequency within a specified frequency band surrounding a resonance peak frequency.

12. A method according to claim 11, wherein said specified frequency band comprises a band of frequencies with a specified deviation from the resonance peak frequency, and wherein said specified deviation comprises one of:

+/−25% from the resonance peak frequency; and

+/−30% from the resonance peak frequency.

13. A method according to claim 1, wherein said resonant frequency comprises at least one of:

a frequency having a transmission coefficient below a background transmission coefficient by at least a specified value; and a frequency within a specified frequency band.

14. A method according to claim 1, wherein said transmission profile comprises a transmission type, and wherein said transmission type comprises one of: continuous wave (CW) transmission, pulsed transmission, sweep transmission and multiple frequency transmission.

15. A method according to claim 1, wherein said transmission profile comprises a transmission direction.

16. A method according to claim 1, wherein said transmission profile comprises a polarization.

17. A method according to claim 1, wherein said determining a resonance profile comprises determining said at least one resonant frequency in accordance with at least one of: a shape of said target reflector, a composition of said target reflector, a surrounding of said target reflector and absorption properties of a body in proximity to said target reflector.

18. A method according to claim 1, wherein said determining a resonance profile comprises obtaining resonance properties of a specified reflector from a database.

19. A method according to claim 1, wherein said determining a resonance profile comprises one of:

receiving a user input describing said resonance profile; and receiving a data communication describing said resonance profile.

20. A method according to claim 1, wherein said determining a resonance profile comprises selecting a common resonant frequency for a plurality of target reflectors, so as to enable reradiation of RF radiation at said common resonant frequency onto said object via a series of said plurality of target reflectors.

21. A method according to claim 1, wherein said transmitting is by a plurality of antennas, and further comprising synchronizing said plurality of antennas to form an antenna array.

22. A method according to claim 1, further comprising measuring radiation reradiated from a target location over a plurality of frequencies, said measuring being performed from a first location.

23. A method according to claim 22, further comprising analyzing said measurements from said first location to determine at least one resonant frequency of said target reflector, wherein said target reflector is located within said target location.

24. A method according to claim 22, further comprising:

analyzing said measurements to identify reflectors located in said target location; and selecting one of said identified reflectors as said target reflector.

25. A method according to claim 1, further comprising positioning a transmitter for performing said transmitting in accordance with at least one of a location of said target reflector and a location of said object.

26. A wireless transmission apparatus for concentrating RF radiation on an object located in proximity to a reflective weapon, comprising:

a memory having stored therein a weapon transmission profile, adapted to a resonance profile of a reflective weapon, said weapon transmission profile comprising at least one resonant frequency of said reflective weapon;

a database comprising respective resonance profiles of a plurality of weapon types; and a transmitter, configured to transmit RF radiation toward a target weapon in accordance with said weapon transmission profile, so as to reradiate said RF radiation from said target weapon onto a proximate object.

27. The apparatus of claim 26, wherein said transmitter is configured to transmit over a frequency band of at least 20 MHz to 2 GHz.

28. The apparatus of claim 26, further comprising a power adjuster configured for adjusting a power of said transmission.

29. The apparatus of claim 26, wherein said weapon transmission profile further comprises at least one of: a transmission power, a transmission bandwidth, a transmission direction and a transmission type.

30. The apparatus of claim 26, wherein said apparatus is portable.

31. The apparatus of claim 26, wherein said apparatus is handheld.

32. The apparatus of claim 26, further comprising a shield configured for blocking said reradiated RF radiation.

33. A wireless transmission system for concentrating RF radiation on an object located in proximity to a reflector, comprising:

a profile database comprising a plurality of transmission profiles, each of said transmission profiles being adapted to a resonance profile of a respective reflector type, wherein each of said transmission profiles comprises at least one resonant frequency of said respective reflector type;

a reflector type selector associated with said profile database, configured for selecting one of said reflector types; and a transmitter associated with said reflector type selector, configured to transmit RF radiation toward a target reflector in accordance with said respective transmission profile of said selected reflector type, so as to reradiate said RF radiation from said target reflector onto a proximate object.

34. The apparatus of claim 33, further comprising:

a reflection measurer, configured for measuring radiation reflected from said target reflector during an RF transmission over a plurality of frequencies;

an analyzer, associated with said reflection measurer, configured for analyzing said measurements to determine at least one resonant frequency of said target reflector; and a transmission profile generator configured for generating a transmission profile of said target reflector in accordance with said analysis.

* * * * *